US007265304B2

(12) United States Patent
Ichiki et al.

(10) Patent No.: US 7,265,304 B2
(45) Date of Patent: Sep. 4, 2007

(54) JOYSTICK FOR ELECTRO-HYDRAULIC CONTROL SYSTEM

(75) Inventors: Nobuhiko Ichiki, Tsuchiura (JP); Mitsuhisa Tougasaki, Tsuchiura (JP); Kaoru Endo, Kiryu (JP); Hiroyasu Masubuchi, Kiryu (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 62 days.

(21) Appl. No.: 11/295,617

(22) Filed: Dec. 7, 2005

(65) Prior Publication Data

US 2006/0117891 A1 Jun. 8, 2006

(30) Foreign Application Priority Data

Dec. 7, 2004 (JP) ..... 2004-354049
Dec. 7, 2004 (JP) ..... 2004-354051

(51) Int. Cl.
*H01H 25/00* (2006.01)

(52) U.S. Cl. ..... 200/6 A; 338/128

(58) Field of Classification Search ..... 200/6 A, 200/6 R, 5 R, 61.45 R; 338/47, 128–131; 345/161–168; 74/471 XY, 548, 555
See application file for complete search history.

(56) References Cited

U.S. PATENT DOCUMENTS 4,490,710 A * 12/1984 Kopsho et al. ..... 200/6 A
4,620,176 A * 10/1986 Hayes ..... 200/61.52
5,107,080 A * 4/1992 Rosen ..... 200/6 A
5,229,742 A * 7/1993 Miyamoto et al. ..... 338/128
5,473,325 A * 12/1995 McAlindon ..... 200/6 A
6,064,369 A * 5/2000 Okabe et al. ..... 200/6 A
6,353,430 B2 * 3/2002 Cheng et al. ..... 200/6 A
6,654,005 B2 * 11/2003 Wang ..... 200/6 A

FOREIGN PATENT DOCUMENTS

JP 2003-157122 A 5/2003

* cited by examiner

*Primary Examiner*—Elvin Enad
*Assistant Examiner*—M. Fishman
(74) *Attorney, Agent, or Firm*—Crowell & Moring LLP

(57) ABSTRACT

A joystick for an electro-hydraulic control system is provided with a rotary potentiometer having a pivotable arm. This pivotable arm is integrally arranged on a rotary shaft and pivots responsive to pivotal control of a joystick in a predetermined direction or a direction opposite to the predetermined direction. The joystick is also provided with a torsion coil spring for normally holding the pivotable arm in a neutral position, a pin arranged on the pivotable arm and capable of expanding the torsion coil spring upon pivotal movement of the pivotable arm, a holding pin for holding the torsion coil spring at its coil portion, and a cover member having a pair of guide portions for limiting movements of the coil portion of the torsion coil spring in the predetermined direction and the opposition direction when the torsion coil spring is in its neutral position.

9 Claims, 17 Drawing Sheets

JOYSTICK FOR ELECTRO-HYDRAULIC CONTROL SYSTEM

FIELD OF THE INVENTION

This invention relates to a joystick for electro-hydraulic control system arranged on a hydraulic excavator or the like. The joystick has a rotary potentiometer equipped with a pivotable arm, which pivots as a result of pivotal control of a control member controlled by an operator, and also with a torsion coil spring normally holding neutral the pivotable arm.

DESCRIPTION OF THE BACKGROUND

The conventional art of this kind includes one disclosed in JP-A-2003-157122. The conventional joystick disclosed in this JP-A-2003-157122 has a control member, specifically a control lever, a rocking means and a rotary potentiometer. The control lever is pivotally controlled by an operator in a predetermined direction or a direction opposite to the predetermined direction. The rocking means comprises gymbals and a cam, which are rockable as a result of a pivotal movement of the control lever. The rotary potentiometer has a support pin with the rocking means supported thereon and a rotary shaft rotatable as a result of a rocking motion of the rocking means, and outputs a rotation angle signal responsive to rotation of the rotary shaft.

The conventional joystick disclosed in JP-A-2003-157122 is also provided with an extension arm, a pivotable arm, and a linkage. The extension arm is arranged integrally on a support pin, and extends toward the rotary potentiometer. The pivotable arm is connected to the extension arm pivotably within a vertical plane parallel to a plane in which a range of pivotal movements of the extension arm is included, and is arranged integrally on the rotary shaft of the rotary potentiometer. The linkage connects the pivotable arm and the extension arm together with predetermined clearances interposed therebetween in the predetermined direction and opposite direction in which the control member is controlled.

The conventional joystick disclosed in JP-A-2003-157122 is further provided with a torsion coil spring, an expanding means, specifically a stopper in the form of a short pin, and a holding pin. The torsion coil spring normally holds the pivotable arm of the rotary potentiometer in a neutral position. The stopper is arranged on the pivotable arm, and upon pivotal movement of the pivotable arm, causes the torsion coil spring to expand. The holding pin is arranged on a housing main body of the rotary potentiometer, and holds the torsion coil spring at its coil portion.

In the conventional joystick of JP-A-2003-157122 constructed as described above, pivotal control of the control level, for example, in the predetermined direction causes the extension arm to pivot about the support pin, and as a result, the pivotable arm pivots via the linkage. Accordingly, the rotary shaft of the rotary potentiometer, said rotary shaft being arranged integrally on the pivotable arm, rotates so that a rotation angle signal corresponding to the stroke of the control lever is outputted. Responsive to the rotation angle signal, an actuator such as an arm cylinder arranged on a hydraulic excavator is driven.

With reference to FIGS. 12A and 12B, a description will now be made about a correlation between the coil portion of the above-mentioned torsion coil spring and the holding pin arranged on the rotary potentiometer and holding the torsion coil spring thereon, although such a correlation is not described specifically in JP-A-2003-157122 referred to in the above.

FIGS. 12A and 12B shows a holding pin 30 arranged on the rotary potentiometer, a torsion coil spring 21 held at a coil portion 21*c* thereof on the holding pin 30, a rotary shaft 13 of the rotary potentiometer, a stopper 18 arranged on the rotary potentiometer and capable of being brought into contact with arm portions 21*a*, 21*b* arranged in continuation with the coil portion 21*c* of the torsion coil spring 21, and an expanding means, specifically a pin 19 formed on an unillustrated pivotable arm, which is arranged integrally with the rotary shaft, and capable of causing the torsion coil spring 12 to expand. The pin 19 corresponds to the stopper in the form of a short pin, which constitutes the expanding means disclosed in JP-A-2003-157122.

FIG. 12A illustrates the form of the torsion coil spring 21 when the control lever is held in its neutral position. The diameter A of the stopper 18 and the diameter B of the pin 19 are set at the same dimension and, when the torsion coil spring 21 is in the neutral position illustrated in FIG. 12A, the arm portions 21*a*, 21*b* of the torsion coil spring 21 are in contact with the stopper pints 18 and 19, respectively, so that the distance L between these arms 21*a* and 21*b* becomes the same as the diameter A of the stopper 18 and the diameter B of the pin 19.

Now assume that the torsion coil spring 21 is in the neutral position as described above and the diameter C of the holding pin 30 is set equal to the inner diameter of the coil portion 21*c* of the torsion coil spring 21. When the torsion coil spring 21, for example, its arm 21*a* is caused to expand by a movement of the pin 19 as a result of a pivotal movement of the pivotable arm as illustrated in FIG. 12B, the coil portion 21*c* of the torsion coil spring 21 contracts in such a way that its diameter becomes smaller. As a result, the coil portion 21*c* progressively cinches up the holding pin 30, and therefore, an excessive tensile force acts on the coil portion 21*c*, leading to a potential problem that the coil portion 21 may be broken.

For the reasons mentioned above, the diameter of the holding pin 30 that holds the torsion coil spring 21 is generally set substantially smaller than the inner diameter of the coil portion 21*c* of the torsion coil spring 21 at the time that the torsion coil spring 21 is in its neutral position.

Because the diameter of the holding pin 30 with the torsion coil spring 21 held thereon is set smaller as mentioned above than the inner diameter of the torsion coil spring 21 at the time that the torsion coil spring 21 is in its neutral position, the conventional joystick is accompanied with inconveniences. A description will hereinafter be made about these inconveniences.

FIGS. 13A through 13C illustrate the construction of an essential part of the rotary potentiometer provided in the conventional art, FIG. 13A is a front view, FIG. 13B is a view corresponding to an H1 section of FIG. 13A, and FIG. 13C is a view corresponding to an H2 section of FIG. 13B. FIGS. 14A and 14B illustrate the inconveniences which arise with the conventional joystick, FIG. 14A shows the inconvenience which arises when the control lever has been controlled in the predetermined direction, and FIG. 14B depicts the inconvenience which arises when the control lever has been controlled in the opposite direction. FIG. 15 diagrammatically shows output characteristics of the rotational potentiometer in the conventional joystick.

FIGS. 13A through 13C illustrate states when the diameter D of a holding pin 20 arranged on a rotary potentiometer 11 is set smaller than the inner diameter of a coil portion 21*c* of a torsion coil spring 21. Also illustrated is a pivotable arm 14 arranged integrally on a rotary shaft 13 of the rotary potentiometer 11. In this pivotable arm 14, a slot 15 that constitutes a linkage is formed. FIG. 13(B) depicts a cover member 31, which limits movements of the rotary shaft 13 along an axis thereof, and a screw 23 maintained in threaded engagement with a threaded portion formed on the holding pin 20. The remaining elements are the corresponding elements in the above-described FIGS. 12A and 12B.

In such conventional art as described above, when an unillustrated control lever is pivotally controlled in a predetermined direction, for example, toward the viewer from the neutral position shown in FIGS. 13A and 13B, the pivotable arm 14 of the rotary potentiometer 11 pivots as a result of the pivotal movement of the control lever as illustrated in FIG. 13C. At this time, force F is applied to the arm portion 21*a* of the torsion coil spring 21 via a pin 19 of the pivotable arm 14, and therefore, the torsion coil spring 21 moves until the coil portion 21*c* is brought into contact with the holding pin 20.

When the unillustrated lever is controlled back from such a controlled position to its neutral position, the torsion coil spring 21 may incline beyond a position which the torsion coil spring 21 is supposed to assume when it is in the original neutral position, that is, the position illustrated in FIG. 13A. As a result, a problem arises in that as shown in FIG. 14A, the pivotable arm 14 stops at a position nearer by an angle η than the original neutral position to which the pivotable arm 14 is supposed to return.

Designated at numeral 16 in FIGS. 14A and 14*b* is a protuberance formed on an unillustrated extension arm which pivots as a result of control of the control lever. By this protuberance 16 and the slot 15 of the pivotable arm 14, a linkage is constructed such that the pivotable arm 14 and the unillustrated extension arm are connected together with predetermined clearances interposed therebetween in the predetermined direction and the opposite direction.

If the pivotable arm 14 of the rotary potentiometer 11 fails to fully return to the neutral position by the angle η despite the return of the control lever to the neutral position as mentioned above, a voltage is outputted as an output error ΔV from the rotary potentiometer 11 as shown in FIG. 15 although the output voltage is supposed to be 0 V.

A similar situation takes place when the unillustrated lever is pivotally controlled in the direction opposite to the above-mentioned pivotal control in the predetermined direction. As illustrated in FIG. 14B, the coil portion 21*c* of the torsion coil spring 21 still remains in contact with the holding pin 20 despite the control of the control lever back to the neutral position. This results in a situation that the pivotable arm 14 fails by an angle η to fully return to the neutral position to which the pivotable arm 14 is supposed to return.

Described specifically, in the prior art including the joystick disclosed in JP-A-2003-157122, the coil portion 21*c* of the torsion coil spring 21, as a result of a pivotal movement of the pivotable arm 14 of the rotary potentiometer 11, is allowed to move until it comes into contact with the holding pin 20. As a consequence, upon controlling back the control lever to the neutral position, a displacement takes place relative to the original neutral position to which the pivotable arm 14 is supposed to return, thereby developing a problem that deteriorations take place in output characteristics.

FIGS. 16, 17A and 17B illustrate other inconveniences of the conventional art. FIG. 16 shows a state at the time of control, while FIGS. 17A and 17B depicts states at the times of returns to the neutral position, respectively. Described specifically, FIG. 17A illustrates an inconvenience that takes place when the control lever is controlled in the predetermined direction, and FIG. 17B depicts another inconvenience that takes place when the control lever is controlled in the direction opposite to the predetermined direction.

FIG. 16 illustrates around the rotary potentiometer, and as mentioned above, shows the holding pin 20 arranged on the housing main body of the rotary potentiometer 11, the torsion coil spring 21 held at its coil portion 21*c* by the holding pin 20, the rotary shaft 13 of the rotary potentiometer 11, a stopper 18 arranged on the housing main body of the rotary potentiometer 11 to limit movements of the arm portions 21*a*, 21*b* of the torsion coil spring in the neutral position, and an expanding means, specifically a pin 19 which is formed on the above-mentioned pivotable arm 14 arranged integrally with the rotary shaft 13 and causes the torsion coil spring 21 to expand. The pin 19 corresponds to the stopper in the form of a short pin, which is disclosed in the above-mentioned JP-A-2003-157122 and constitutes the expanding means. In the pivotable arm 14, the slot 15 is formed to construct the linkage with which an unillustrated extension arm is arranged in continuation.

FIG. 16 is now referred to. In the conventional art disclosed in JP-A-2003-157122 and the like, a point a on a circumferential sidewall of the arm portion 21*a* of the torsion coil spring 21 and a point b on a side edge of the arm portion 21*a* of the torsion coil spring 21 are in contact with each other in the neutral position. By a pivotal movement of the pivotable arm 14 over an angle of θ2 as a result of pivotal control of the unillustrated control lever, for example, in the predetermined direction, however, the point of contact of the torsion coil spring 21 with the pin 19 arranged on the pivotable arm 14 shifts from the above-mentioned point b to a point c. Namely, as a result of repeated pivotal control of the control lever, the sliding contact between the pin 19 on the pivotable arm 14 and the arm portion 21*a* of the torsion coil spring 21 is repeated, and as a result, abrasion tends to occur at their sliding parts.

When such abrasion occurs, a recessed portion formed on the arm portion 21*a* of the torsion coil spring 21 by the abrasion enters another recessed portion formed on the circumferential sidewall of the pin 19 by the abrasion, thereby developing a situation that the pivotable arm 14 shown in FIG. 17A fails to return fully to the original neutral position, to which the pivotable arm 14 is supposed to return, and stops at a position nearer by an angle η than the neutral position.

When there occurs the situation that the pivotable arm 14 fails by the angle η to fully return to the neutral position as mentioned above, the output voltage from the rotary potentiometer 11 becomes an output error ΔV as shown in the above-described FIG. 15 although it is supposed to become 0 V at the neutral position.

A similar situation takes place when the unillustrated control lever is pivotally controlled in the direction opposite to the above-mentioned direction. As illustrated in FIG. 17B, even when the control lever is controlled back to the neutral position, there arises a situation that as a result of the abrasion of the pin 19 on the pivotable arm 14 and the arm portion 21*b* of the torsion coil spring 21, the pivotable arm 14 fails by an angle η to fully return to the original neutral position to which the pivotable arm 14 is supposed to return.

In the conventional art equipped with a torsion coil spring, including the technique disclosed in JP-A-2003-157122, abrasion tends to occur between the arm portions 21*a*, 21*b* of the torsion coil spring 21 and the pin 19 on the pivotable arm, said pin 19 serving to expand these arm portions 21*a*, 21*b*, as a result of pivotal movements of the pivotable arm 14 of the rotary potentiometer 1 by repeated pivotal control of the control lever. The conventional art, therefore, involves the problem that, when the control lever is controlled back to the neutral position, the abrasion causes a displacement relative to the original neutral position to which the pivotable arm 14 is supposed to return and the displacement leads to deteriorations in output characteristics.

SUMMARY OF THE INVENTION

The present invention has been completed in view of the above-mentioned actual situation of the conventional art. An object of the present invention is, therefore, to provide a joystick for an electro-hydraulic control system, which is provided with a torsion coil spring to normally hold neutral a pivotable arm arranged on a rotary potentiometer and allows the pivotable arm to surely return to the original neutral position to which the pivotable arm is supposed to return.

To achieve the above-described object, the present invention provides a joystick for an electro-hydraulic control system, said joystick being provided with:

a control member pivotally controllable by an operator in a predetermined direction or in a direction opposite to the predetermined direction;

a rocking means rockable as a result of pivotal control of the control member;

a support pin supporting the rocking means thereon;

a rotary potentiometer having a rotary shaft rotatable as a result of a rocking motion of the rocking means, said rotary potentiometer being capable of outputting a rotation angle signal responsive to rotation of the rotary shaft;

an extension arm arranged integrally on the support pin and extending toward the rotary potentiometer;

a pivotable arm connected to the extension arm pivotably within a vertical plane parallel to a plane in which a range of pivotal movements of the extension arm is included, and arranged integrally on the rotary shaft of the rotary potentiometer;

a linkage connecting the pivotable arm and the extension arm together with predetermined clearances interposed therebetween in the predetermined direction and opposite direction in which the control member can be controlled;

a torsion coil spring for normally holding the pivotable arm of the rotary potentiometer in a neutral position;

an expanding means arranged on the pivotable arm to expand the torsion coil spring upon pivotal movement of the pivotable arm; and a holding pin arranged on the rotary potentiometer and holding the torsion coil spring at a coil portion thereof, wherein:

the joystick is provided with a means for limiting movements of the coil portion of the torsion coil spring in the predetermined direction and the opposition direction when the torsion coil spring is in a neutral position.

In the present invention constructed as described above, movements of the coil portion of the torsion coil spring in the predetermined direction and the opposite direction are limited by the limiting means in a state that the control member is held neutral. The torsion coil spring is, therefore, held in a correct position without any substantial inclination, so that the pivotable arm of the rotary potentiometer is held in an upright position without any substantial inclination. As a consequence, the rotary shaft arranged integrally with the pivotable arm is held in the correct neutral position. In this state, the predetermined clearances are formed in the predetermined direction and the opposite direction, respectively, at the linkage which connects the pivotable arm and the extension arm together. These predetermined clearances form a dead zone for the control of the control member. No rotation angle signal is, therefore, outputted from the rotary potentiometer even when the control member slightly moves within the range of the dead zone.

When the control member is controlled from such a neutral position to such an extent as moving beyond the above-mentioned dead zone, the extension arm pivots about the support pin, and as a result, the pivotable arm of the rotary potentiometer pivots via the linkage so that the rotary shaft arranged integrally with the pivotable arm rotates. As a result, a rotation angle signal corresponding to the stroke of the control member is outputted. In the meantime, the torsion coil spring is caused to expand by the expanding means of the pivotable arm, the coil portion of the torsion coil spring contracts, and under force applied via the expanding means, the coil portion of the torsion coil spring becomes about to move. However, this move is limited by the limiting means. Specifically, the coil portion of the torsion coil spring contracts while sliding in contact with the limiting means.

When the control member is controlled back to the neutral position from the above-described controlled position, the force applied via the expanding means of the pivotable arm is removed so that the torsion coil spring returns into its neutral form. At this time, the coil portion of the torsion coil spring expands from the state contracted as described above but, as soon as the torsion coil spring reaches its neutral state, its movements in the predetermined direction and the opposite direction are limited by the limiting means. In the neutral state, the torsion coil spring, therefore, has returned to its correct position without any inclination, and as a result, the pivotable arm is also held in the original upright position and the rotary shaft of the rotary potentiometer is allowed to surely return to the correct neutral position.

As has been described above, the torsion coil spring which holds the pivotable arm in the neutral position returns to the correct neutral position by the limiting means when the control member is controlled back from a controlled position to the neutral position. The present invention, therefore, allows the pivotable arm of the rotary potentiometer, said pivotable arm being in engagement with the torsion coil spring, to surely return to the original neutral position without any substantial inclination.

In the present invention as described above, the joystick can preferably be provided with a cover member for limiting movements of the torsion coil spring in directions intersecting at right angles with the predetermined direction and the opposite direction, respectively, and the limiting means can preferably comprise a pair of guide portions arranged on the cover member such that, when the torsion coil spring is in the neutral position, the guide portions are maintained in contact with opposite side portions of the coil portion. The present invention constructed as described above does not lead to an increase in the number of parts, because the cover member is provided with the pair of guide portions which in their neutral positions, are maintained in contact with the opposite side portions of the coil portion.

In the present invention as described above, the cover member can preferably be made of a metallic material, and the guide portions preferably can have been formed by bending. The present invention constructed as described above makes it possible to form the pair of guide portions by simply bending the cover member, and therefore, the fabrication of the guide portions is simple.

In the present invention as described above, the holding pin of the rotary potentiometer can preferably have a threaded portion, and the joystick can preferably be provided with a screw maintained in engagement with the threaded portion of the holding pin to fasten the cover member on the holding pin. In the present invention constructed as described above makes, the cover member can be firmly fixed by the screw.

In the present invention as described above, the expanding means can preferably comprise a pin formed on the pivotable arm. In the present invention constructed as described above, a pin which forms the expanding means can be arranged on the arm by press-fitting, crimping or any other suitable method upon fabrication of the pivotable arm.

The present invention also provides a joystick for an electro-hydraulic control system, the joystick being provided with:

a control member pivotally controllable by an operator;

a rocking means rockable as a result of pivotal control of the control member;

a support pin supporting the rocking means thereon;

a rotary potentiometer having a rotary shaft rotatable as a result of a rocking motion of the rocking means, said rotary potentiometer being capable of outputting a rotation angle signal responsive to rotation of the rotary shaft;

an extension arm arranged integrally on the support pin and extending toward the rotary potentiometer;

a pivotable arm connected to the extension arm pivotably within a vertical plane parallel to a plane in which a range of pivotal movements of the extension arm is included, and arranged integrally on the rotary shaft of the rotary potentiometer;

a torsion coil spring for normally holding the pivotable arm of the rotary potentiometer in a neutral position;

a stopper for limiting movements of arm portions of the torsion coil spring when the torsion coil spring is in a neutral position; and an expanding means for expanding the arm portions of the torsion coil spring upon pivotal movement of the pivotable arm, wherein:

the expanding means comprises a rotary member.

In the present invention constructed as described above, control of the control member from its neutral position causes the extension arm to pivot about the support pin. As a result, the pivotable arm of the rotary potentiometer pivots, and the rotary shaft arranged integrally with the pivotable arm rotates. As a result, a rotation angle signal corresponding to the stroke of the control member is outputted. In the meantime, the arm portion of the torsion coil spring is caused to expand by a rotary member which constitutes the expanding means. As a result of the expansion of the arm portions of the torsion coil spring, the rotary member maintained in contact with the arm portion rotates. It is, therefore, possible to inhibit the occurrence of abrasion between the rotary member and the arm portions of the torsion coil spring, which would otherwise take place as a result of repeated pivotal control of the control member.

When the control member is caused to return to the neutral position from the above-mentioned controlled state of the control member, the force which has been applied to the arm portions of the torsion coil spring via the rotary member of the pivotable arm is removed, the torsion coil spring returns to its neutral position, and therefore, movements of the arm portions of the torsion coil spring are limited by the stopper. Since the occurrence of abrasion at the rotary member and the arm portions of the torsion coil spring as a result of repeated pivotal control of the control members is inhibited by rotation of the rotary member, no recessed portions are formed by abrasion on the rotary member and the arm portions of the torsion coil springs so that the rotary member and the arm portions of the torsion coil spring can be maintained in their original forms over a long term. Accordingly, the pivotable arm is held in its original upright position at the neutral position and the rotary shaft of the rotary potentiometer can be brought back to the correct neutral position.

As has been described above, the present invention can inhibit, owing to the rotation of the rotary member, the abrasion between the arm portions of the torsion coil spring and the rotary member, which causes the arm portions to expand, as a result of repeated pivotal control of the control member. When the control member has been caused to return from the controlled position to the neutral position, the pivotable arm of the rotary potentiometer, said pivotable arm being I engagement with torsion coil spring, is allowed to return to the original neutral position without any substantial inclination.

In the above-described invention, the rotary member can comprise a bearing.

In the above-described invention, the stopper can preferably be arranged on a housing main body of the rotary potentiometer, and the bearing can rotatably be mounted on a pin portion formed on the pivotable arm of the rotary potentiometer.

In the above-described invention, the stopper can preferably be arranged on the pivotable arm of the rotary potentiometer, and the bearing can preferably be arranged on a pin portion formed on a housing main body of the rotary potentiometer.

Owing to the arrangement of the means for limiting movements of the coil portion of the torsion coil spring at its neutral position in the predetermined direction and the opposite direction, the present invention allows the pivotable arm, to which the torsion coil spring is brought into engagement, of the rotary potentiometer to surely return to the original neutral position. It is, therefore, possible to avoid any substantial displacement of the pivotable arm from its original neutral position when the control member is controlled back to its neutral position. Accordingly, output characteristics of high accuracy can be obtained compared with the conventional art.

In the present invention, the rotary member rotates when the arm portions of the torsion coil spring are caused to expand by a pivotal movement of the pivotable arm of the rotary potentiometer as a result of pivotal control of the control member. Owing to the above-mentioned rotation of the rotary member, it is, therefore, possible to inhibit the abrasion between the rotary member and the arm portions of the torsion coil spring that would otherwise take place as a result of repeated pivotal control of the control member. The rotary member and the arm portions of the torsion coil spring can, therefore, be maintained in their deformation-free, original forms over a long term, so that the pivotable arm, with which the torsion coil spring is brought into engagement, of the rotary potentiometer is allowed to surely return to the original neutral position. In other words, it is possible to avoid any substantial displacement of the pivotable arm from its original neutral position when the control member is controlled back to its neutral position, thereby making it possible to obtain output characteristics of high accuracy compared with the conventional art.

BRIEF DESCRIPTION OF THE DRAWINGS

FIGS. 1A and 1B illustrates a joystick according to a first embodiment of the present invention for an electro-hydraulic control system, in which FIG. 1A is a plan view of the joystick without a control lever, and FIG. 1B is a front view of the joystick with the control lever illustrated in imaginary lines.

FIGS. 3A through 3C depict the construction of an essential part of the rotary potentiometer arranged in the joystick according to the first embodiment, in which FIG. 3A is a front view, FIG. 3B is a view corresponding to a G1 section of FIG. 3A, and FIG. 3C is a view corresponding to a G2 section of FIG. 3B.

FIGS. 6A and 6B illustrates a joystick according to a second embodiment of the present invention for an electro-hydraulic control system, in which FIG. 6A is a plan view of the joystick without a control lever, and FIG. 6B is a front view of the joystick with the control lever illustrated in imaginary lines.

FIGS. 7A through 7C depict the construction of an essential part of the rotary potentiometer arranged in the joystick according to the second embodiment, in which FIG. 7A is a front view, FIG. 7B is a view corresponding to a G1 section of FIG. 7A, and FIG. 7C is a view corresponding to a G2 section of FIG. 7B.

FIGS. 11A and 11B depicts a joystick according to a third embodiment of the present invention for an electro-hydraulic control system, in which FIG. 11A is a front view showing the construction of an essential part of a rotary potentiometer at a neutral time, and FIG. 11B is a front view depicting the construction of the essential part of the rotary potentiometer at the time of control.

FIGS. 13A through 13C depict the construction of an essential part of a rotary potentiometer arranged in the conventional art, in which FIG. 13A is a front view, FIG. 13B is a view corresponding to an H1 section of FIG. 13A, and FIG. 13C is a view corresponding to an H2 section of FIG. 13B.

FIGS. 14A and 14B illustrate inconveniences which arise in the conventional art, in which FIG. 14A shows an inconvenience which arises when a control lever is controlled in a predetermined direction, and FIG. 14B depicts an inconvenience which arises when the control lever is controlled in a direction opposite to the predetermined direction.

FIGS. 17A and 17B illustrate inconveniences which arise in the conventional art, especially states upon returning to the neutral position, in which FIG. 17A shows an inconvenience which arises when a control lever is controlled in a predetermined direction, and FIG. 17B depicts an inconvenience which arises when the control lever is controlled in a direction opposite to the predetermined direction.

DETAILED DESCRIPTION OF PREFERRED EMBODIMENTS

Best modes for carrying out the present invention will hereinafter be described base on the accompanying drawings.

First Embodiment

[Basic Construction of the First Embodiment]

Figure 1A:
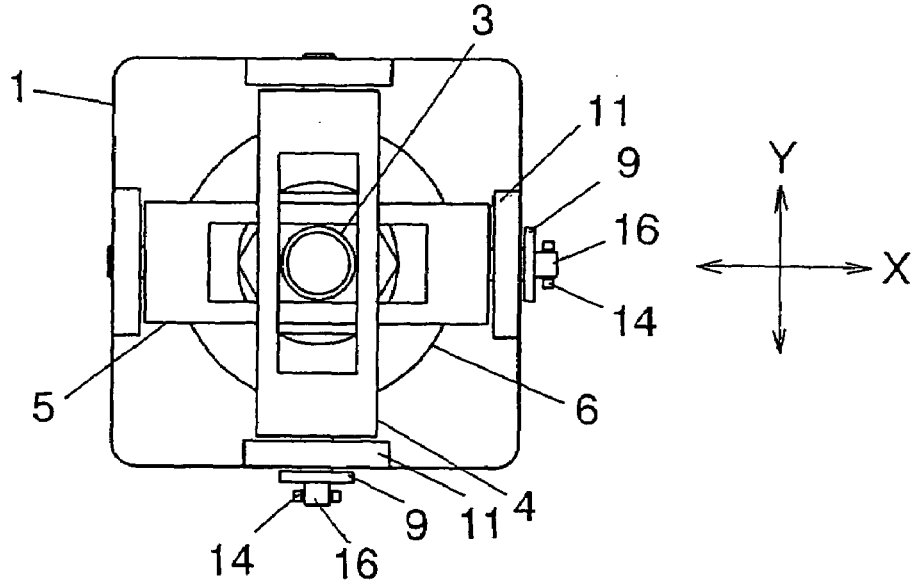
Figure 1B:
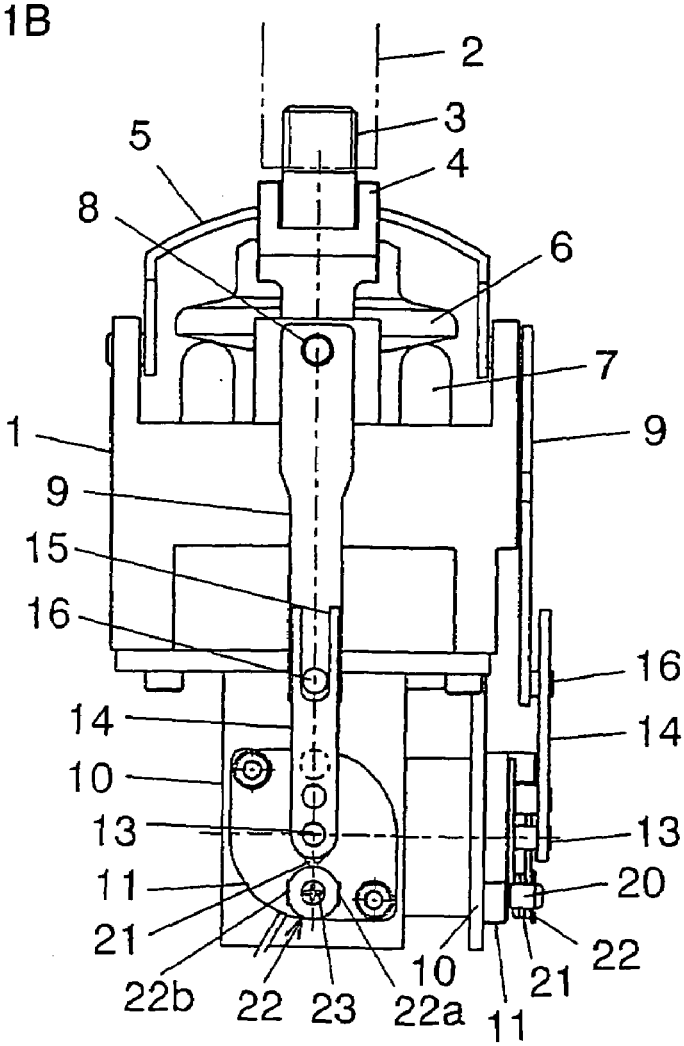

Firstly, the joystick according to the first embodiment of the present invention for the electro-hydraulic control system will be described with reference to FIGS. 1A through 3C. The joystick of the first embodiment is used, for example, as a joystick for controlling various hydraulic cylinders or hydraulic actuators, such as hydraulic motors, arranged in a hydraulic excavator. As illustrated in FIGS. 1A and 1B, the joystick of the first embodiment is provided with a housing main body 1 for a control lever unit, a control member, for example, a control lever 2 pivotally controlled by an operator, a universal joint 3 connected with the control lever 2, a first gymbal 4 rockably supported on the housing main body 1 and rockable as a result of pivotal control of the control lever 2, for example, in a direction X, a second gymbal 5 arranged extending in a direction which intersects at right angles with a direction in which the first gymbal 4 extends, rockably supported on the housing main body 1 and rockable as a result of pivotal control of the control lever, for example in a direction Y, a cam 6 rockable responsible to pivotal control of the control lever in the direction X or the direction Y or in a direction intermediate between the direction X and the direction Y, and a plurality of pushrods 7 movable up or down responsive to a rocking motion of the cam 6 and transmitting neutralizing return force of the cam 6.

The above-mentioned first gymbal 4, second gymbal 5 and cam 6 constitute a rocking means which rocks as a result of a pivotal control of the control lever 2.

On one side of the housing main body 1, said one side forming a front side as viewed in FIG. 1B, there is arranged a support pin 8 with the gymbals 4,5 supported as the above-mentioned rocking means thereon. Mounted on a bracket 10 fixed underneath the housing main body 1 are a rotary shaft 13 rotatable as a result of a rocking motion of the above-mentioned rocking means and a rotary potentiometer 11 capable of outputting a rotation angle signal corresponding to rotation of the rotary shaft 13. On the side of another wall of the housing main body 1, said another wall intersecting at right angles with the one side of the housing main body 1, there are also arranged a support pin 8, a bracket 10 and a rotary potentiometer 11 all of which are similar to those mentioned above.

As the construction including the support pin 8, the rotary potentiometer 11 and the like arranged on the above-mentioned one side of the housing main body 1 is the same as the construction including the support pin 8, the rotary potentiometer 11 and the like arranged on the above-mentioned another side of the housing main body 1, a description will hereinafter be made primarily about the construction arranged on the one side of the housing main body 1.

On the support pin 8 arranged on the one side of the housing main body 1, that is, on the front side as viewed in FIG. 1B, an extension arm 9 is integrally arranged such that it extends toward the rotary potentiometer 11, and on a lower end of the extension arm 9, a protuberance 16 is formed. The rotary potentiometer 11 has a pivotable arm 14, which is connected to the extension arm 9 pivotably within a vertical plane parallel to a plane, in which a range of pivotal movements of the extension arm 9 is included, and is arranged integrally on the rotary shaft 13 of the rotary potentiometer 11. A slot 15 is formed in an upper end of the pivotable arm 14, and in the slot 15, the protuberance 16 of the extension arm 9 is received.

Constructed by these protuberance 16 and slot 15 is the linkage which connects the pivotable arm 14 and the extension arm 9 together with predetermined clearances interposed therebetween in the predetermined direction of the control lever 2, for example, in the leftward direction as viewed in FIG. 1B and in the direction opposite to the predetermined direction, namely, the rightward direction as viewed in FIG. 1B, respectively.

Figure 2:
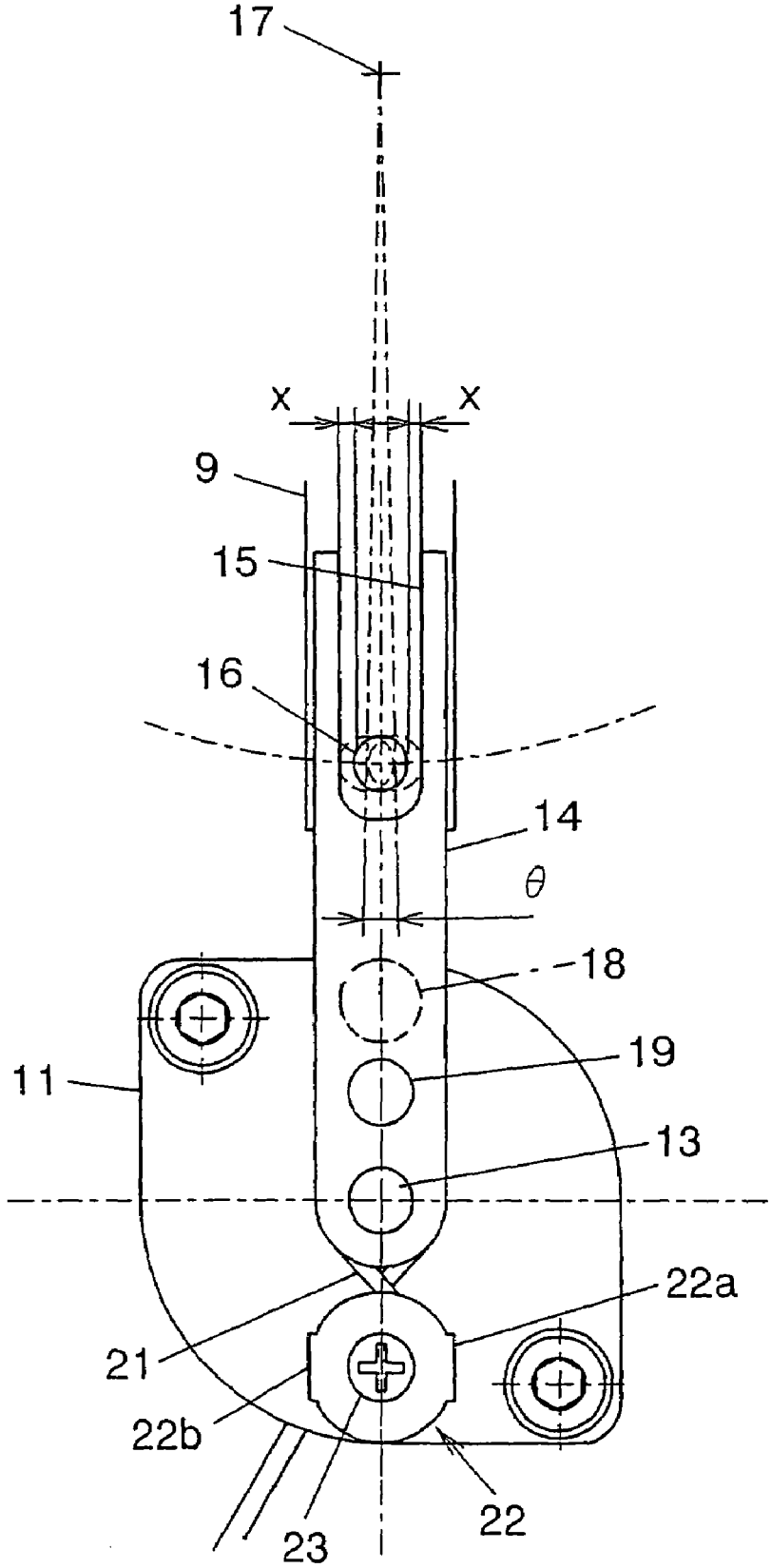
FIG. 2 is a front view illustrating a positional relation between a slot, which is formed in a pivotable arm of a rotary potentiometer arranged in the joystick according to the first embodiment, and a protuberance arranged on an extension arm also arranged in the joystick according to the first embodiment.

In a state that the control lever 2 is held neutral as shown in FIG. 2, clearances X of the same dimension are formed between both edge portions of the slot 15 of the pivotable arm 14 and both side portions of the protuberance 16 of the extension arm 9, respectively. Designated at numeral 17 in FIG. 2 is a center of the support pin 8, namely, a pivot for the extension arm 9. Further, θ in FIG. 2 is an angle formed between a line, which connects a center of the protuberance 16 and the pivot 17 when the protuberance 16 has come into contact with one of the edge portions of the slot 15 in the pivotable arm 14 held in the neutral state, and a line which connects the center of the protuberance 16 and the pivot 17 with each other when the protuberance 16 has come into contact with the other edge portion of the slot 15 in the pivotable arm 14 held in the neutral state. A dead zone for the pivotal control of the control lever 2 is formed by this angle θ.

Figure 3A:
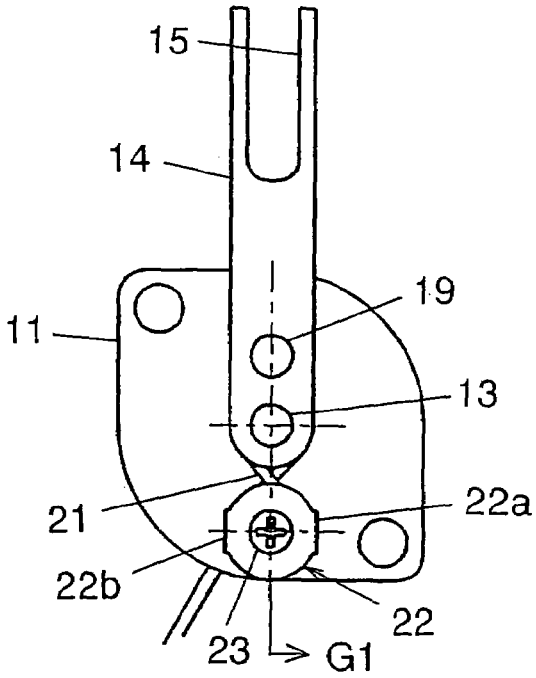
Figure 3B:
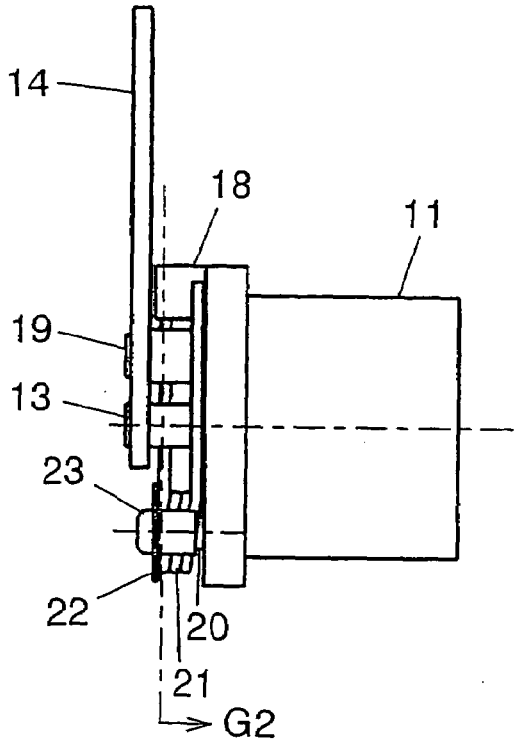
Figure 3C:
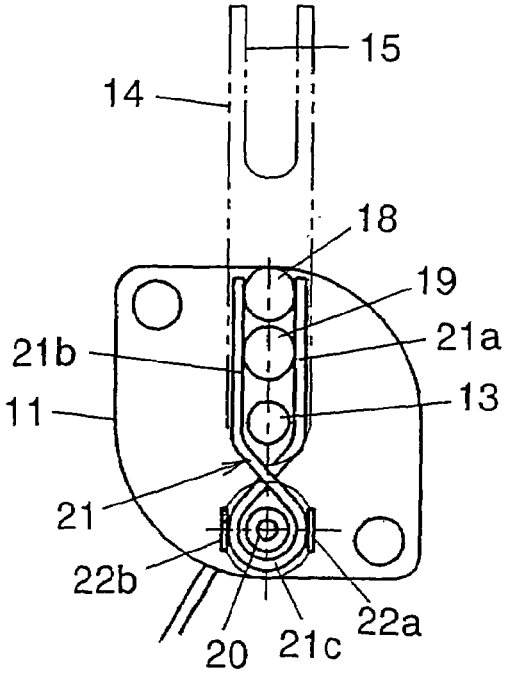

As illustrated in FIGS. 3A through 3C, this embodiment is equipped with a torsion coil spring 21 which holds the pivotable arm 14 of the rotary potentiometer 11 at the neutral position. This torsion coil spring 21 has a coil portion 21*c* and a pair of arm portions 21*a*, 21*b* arranged in continuation with the coil portion 21*c*. Formed on the pivotable arm 14 is an expanding means for causing the torsion coil spring 21 to expand upon pivotal movement of the pivotable arm 14, for example, a pin 19. Further, the rotary potentiometer 11 is provided with a holding pin 20 with the coil portion 21*c* of the above-mentioned torsion coil spring 21 held thereon, and also with a stopper 18 for limiting movements of the arm portions 21*a*, 21*b* of the torsion coil spring 21 in directions opposite each other.

It is to be noted that the outer diameter of the above-mentioned holding pin 20 is set substantially smaller than the inner diameter of the coil portion 21*c* of the torsion coil spring 21 and that a threaded portion is formed on the holding pin 20.

As also illustrated in FIG. 2, this embodiment is provided with a cover member 22 and a screw 23. The cover member 22 limits movements of the torsion coil spring 21 in directions, which intersect at right angles with the predetermined direction and the opposite direction, within a vertical plane in the direction X shown in the above-described FIG. 1, and is made, for example, of a metallic material. The screw 23 is maintained in threaded engagement with the threaded portion of the holding pin 20 to fasten the cover member 22 on the holding pin 20.

[Construction of Essential Part of the First Embodiment]

Specifically described, this embodiment is provided with the limiting means for limiting movements of the coil portion 21*c* of the torsion coil spring 21 in the above-mentioned predetermined direction and opposite direction at the neutral position of the torsion coil spring 21. As illustrated in FIG. 3C, this limiting means is arranged on the cover member 22, and comprises a pair of guide portions 22*a*, 22*b* which are maintained in contact with both side portions of the coil portion 21*c* of the torsion coil spring 21 at the neutral position.

[Operation of the First Embodiment]

Figure 4:
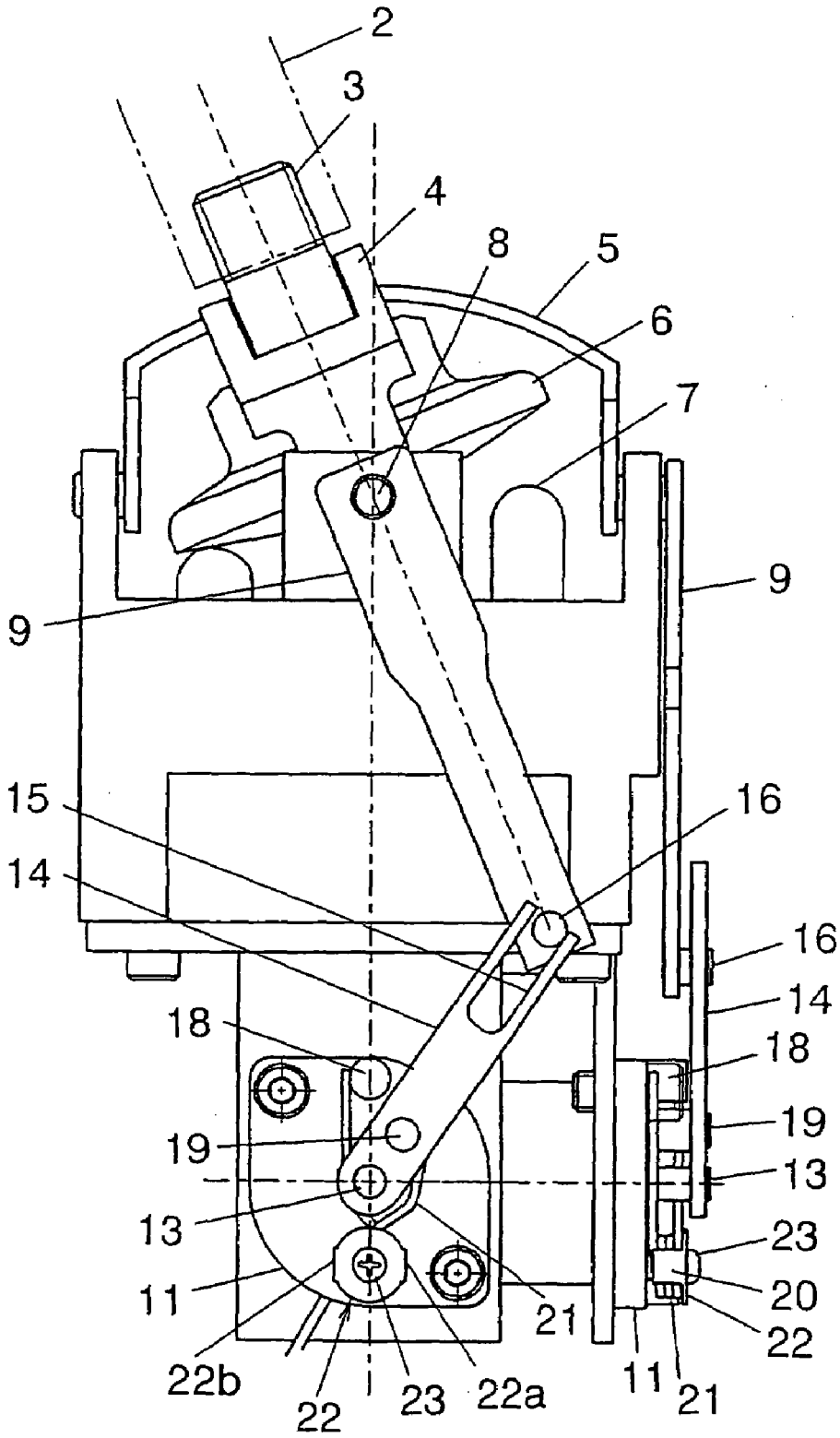
FIG. 4 is a front view illustrating an operation of the joystick according to the first embodiment.
Figure 5:
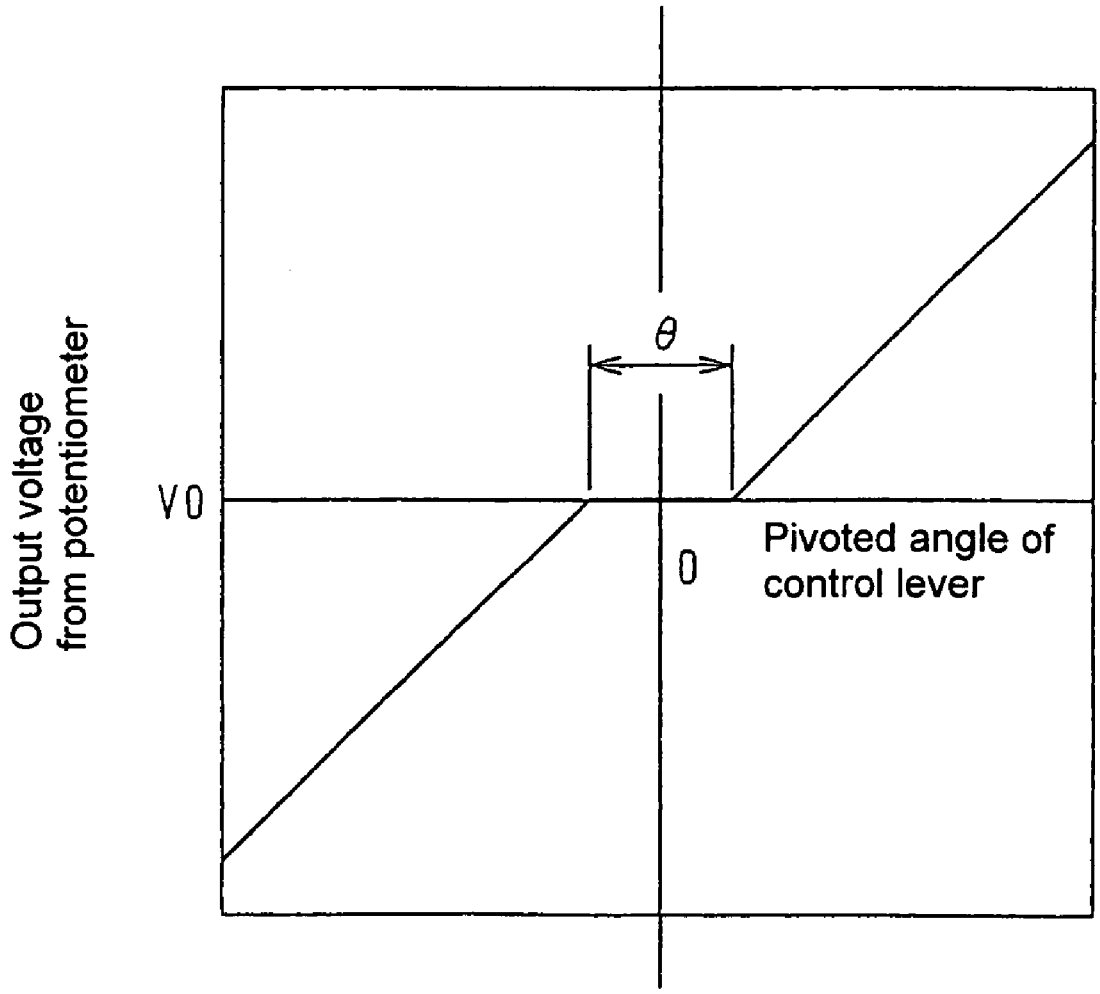
FIG. 5 is a diagram showing output characteristics of the rotary potentiometer as obtained from the joystick according to the first embodiment.

With reference to FIGS. 4 and 5, the operation of the joystick according to this embodiment for the electro-hydraulic control system will next be described. Movements of the coil portion 21*c* of the torsion coil spring 21 in the predetermined direction and opposite direction of the control lever 2 within the vertical plane of the direction X shown in FIG. 1A are limited by the pair of guide portions 22*a*, 22*b* of the cover member 22 depicted in FIG. 3C in the state that the control lever 2 is held neutral as illustrated in FIG. 1B. The torsion coil spring 21 is, therefore, held in a correct position without any substantial inclination, and as a result, the pivotable arm 14 of the rotary potentiometer 11 is held in the upright position without any substantial inclination. As the rotary shaft 13 rotates integrally with the pivotable arm 14, the rotary shaft 13 is also held in the neutral position. In this state, the equal clearances X are formed on the both sides of the protuberance 16 of the extension arm 9, said protuberance 16 being positioned within the slot 15 of the pivotable arm 14. By these clearances X, the dead zone which corresponds to the above-mentioned angle θ is formed for pivotal control of the control lever 2. Even when the control lever 2 slightly moves within the dead zone corresponding to the angle θ as illustrated in FIG. 5, no rotation angle signal is, therefore, outputted from the rotary potentiometer 11, thereby preventing false actuation of a hydraulic actuator due to vibrations or the like produced as a result of an operation of an engine mounted on a hydraulic excavator which is equipped with the joystick of this embodiment.

When the control lever 2 shown in FIG. 1B is controlled from such a neutral state in the predetermined direction, for example, in the leftward direction as viewed in FIG. 1B beyond the stroke corresponding to the above-mentioned dead zone, for example, within the vertical plane of the direction X in FIG. 1A, the extension arm 9 pivots about the support pin 8 as shown in FIG. 4. As a result, via the protuberance 16 of the extension arm 9 and the slot 15 of the pivotable arm 14, the pivotable arm 14 of the rotary potentiometer 11 pivots against the biasing force of the torsion coil spring 21, and the rotary shaft 13 also rotates. Accordingly, a rotation angle signal is outputted corresponding to the stroke of the control lever 2. In the meantime, by the pin 19 of the pivotable arm 14, the arm 21*a* of the torsion coil spring 21, said arm 21*a* being depicted in FIG. 3C, is caused to expand. Therefore, the coil portion 21*c* of the torsion coil spring 21 is caused to contract and under force applied via the pin 19, the coil portion 21*c* of the torsion coil spring 21 becomes about to move in the rightward direction as viewed in FIG. 3C. This movement is, however, limited by the guide portion 22*a*. Specifically, the coil portion 21*c* of the torsion coil spring 21 contracts while sliding in contact with the guide portion 22*a*.

When the control lever 2 is controlled back to the neutral position from the position to which the control lever 2 has been controlled as mentioned above, the force applied via the pin 19 of the pivotable arm 14 is removed so that the torsion coil spring 21 returns into the neutral state. At this time, the coil portion 21*c* of the torsion coil spring 21 expands from the contracted state. When the coil portion 21*c* has reached its neutral state, however, movements of the both side portions of the coil portion 21 in the above-mentioned predetermined direction are limited by the paired guide portions 22*a*, 22*b*. In the neutral state, the torsion coil spring 21 has returned to its correct position without any substantial inclination as illustrated in FIG. 3C. As a result, the pivotable arm 14 is also held in its original upright position, and the rotary shaft 13 of the rotary potentiometer is allowed to surely return to the correct neutral position. This embodiment, therefore, can obtain the output characteristics shown in FIG. 5.

In the above, the description made about the case that the control lever 2 was controlled in the direction X as viewed in FIG. 1A. Similar operations are also performed when the control lever 2 is controlled in the direction Y as viewed in FIG. 1A. When he control lever 2 is controlled in an intermediate direction between the direction X and the direction Y as viewed in FIG. 1A, corresponding rotation angle signals are outputted by similar operations as mentioned above from the two rotary potentiometers, respectively.

[Advantageous Effects of the First Embodiment]

According to this embodiment constructed as described above, the arrangement of the guide portions 22*a*, 22*b*, which limit movements of the coil portion 21*c* of the torsion coil spring 21 in the predetermined direction and the opposite direction at the neutral position thereof, can surely make the pivotable arm 14 of the rotary potentiometer 11, said pivotal arm 14 being in engagement with the torsion coil spring 21, return to the original neutral position. In other words, it is possible to avoid any substantial displacement of the pivotable arm 14 relative to its original neutral position when the control lever 2 has been returned to its neutral position, thereby making it possible to obtain high-accuracy output characteristics free of output errors as illustrated in FIG. 5.

The limiting means for limiting movements of the coil portion 21*c* of the torsion coil spring 21 at its neutral position in the predetermined direction and the opposite direction is composed of the paired guide portions 22*a*, 22*b*, and these guide portions 22*a*, 22*b* are formed on the cover member 22 which limits movements of the torsion coil spring 21 in the directions perpendicular to the above-mentioned predetermined direction and the opposite direction, respectively. It is, therefore, possible to avoid any increase in the number of parts and also to suppress a rise in manufacturing cost.

As the paired guide portions 22*a*, 22*b* can be formed by simply bending opposite end portions of the cover member 22 made of a metallic material, the fabrication of these guide portions 22*a*, 22*b* is simple so that an increase in manufacturing cost can be suppressed.

Further, it is designed to fasten the cover member 22 to the holding pin 20 by the screw 23. The cover member 22 can, therefore, be firstly fixed on the holding pin 20, thereby making it possible to provide a high-reliability structure.

In addition, the expanding means for expanding the torsion coil spring 21 as a result of a pivotal movement of the pivotable arm 14 can be constructed of the pin 19 formed integrally on the pivotable arm 14, and this pin 19 can be arranged on the pivotable arm 14 concurrently at the time of the fabrication of the pivotable arm 14. It is, therefore, possible to avoid any increase in the number of parts and also to suppress a rise in manufacturing cost.

Second Embodiment

[Basic Construction of the Second Embodiment]

The joystick according to the second embodiment of the present invention for the electro-hydraulic control system will next be described with reference to FIGS. 6A through 8. It is to be noted that the basic construction itself is similar to that described with reference to FIG. 1A through FIG. 3C except for the construction of the cover member 22 and the construction around the rotary shaft 13 of the pivotable arm 14, overlapping descriptions will be omitted and only different features will be described.

Figure 6A:
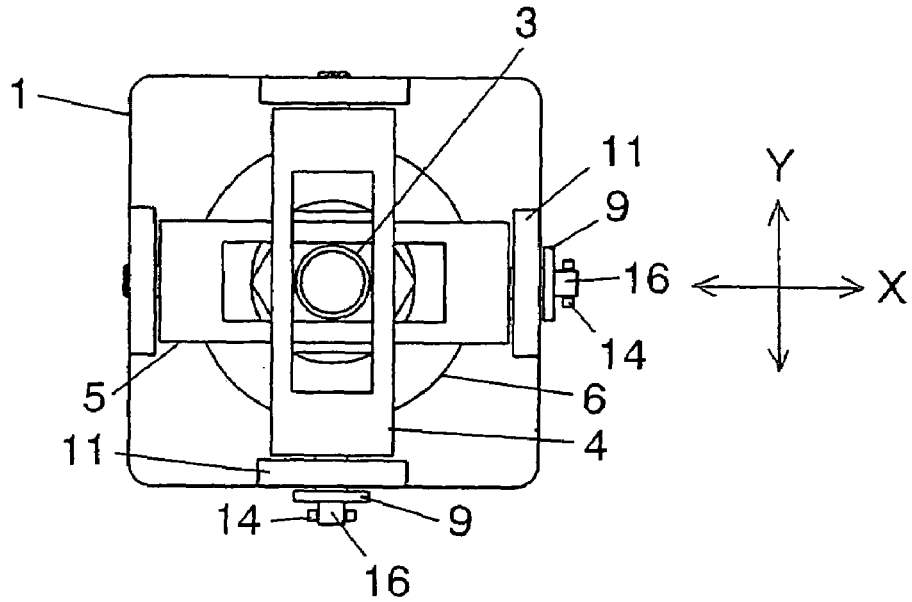
Figure 6B:
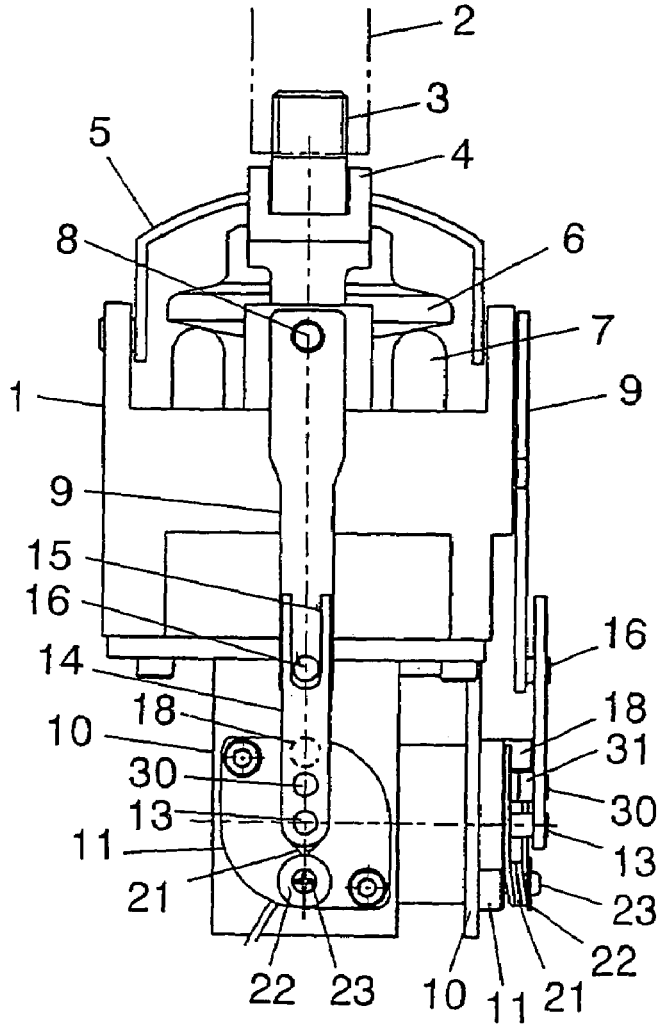

This embodiment is different from the first embodiment in that as illustrated in FIGS. 6A and 6B, the cover member 22 is not provided with the guide portions 22*a*, 22*b*, the stopper 18 and the like are modified, and a pin portion 30 and a bearing 31 are arranged. Details will be mentioned next.

[Construction of Essential Part of the Second Embodiment]

Figure 7A:
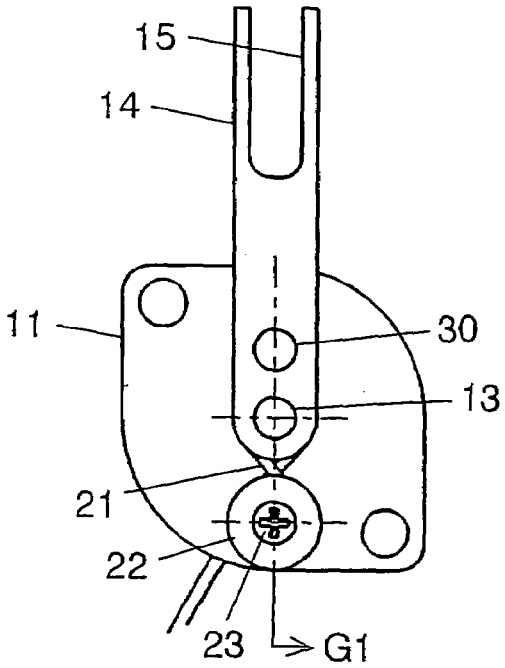
Figure 7B:
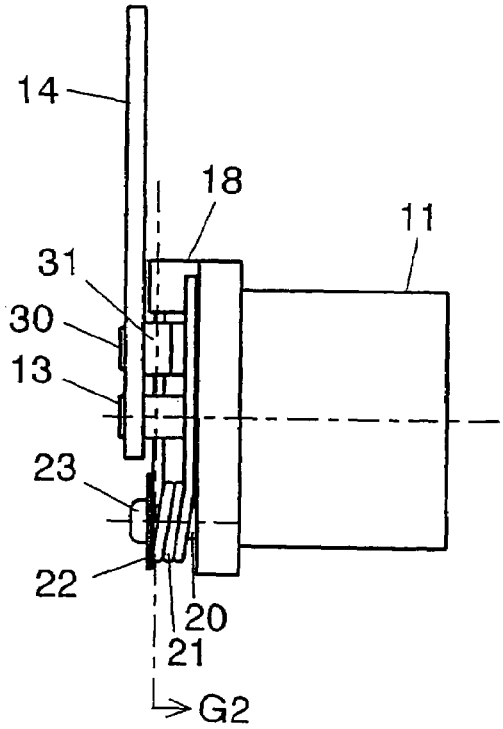
Figure 7C:
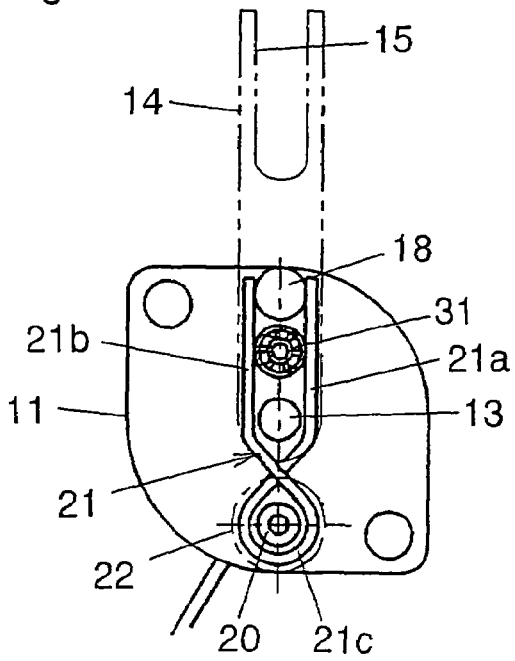
Figure 8:
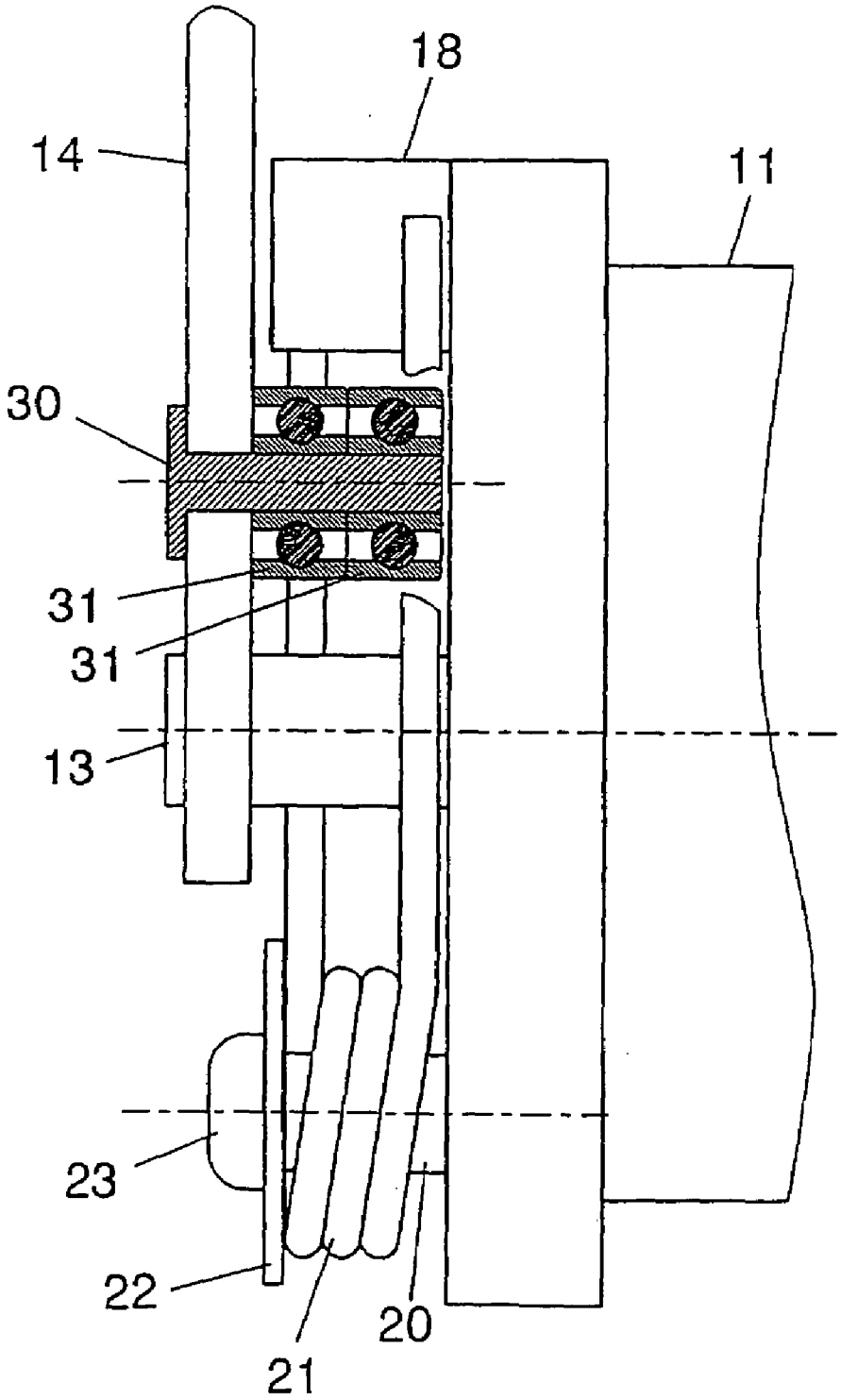
FIG. 8 is a fragmentary cross-sectional view similar to FIG. 7B but depicts the elements on an enlarged scale.

As shown in FIG. 7A through FIG. 8 and the like, this embodiment is equipped with the torsion coil spring 21 for holding the pivotable arm 14 of the rotary potentiometer 11 at its neutral position. This torsion coil spring 21 has the coil portion 21*a* and the paired arm portions 21*a*, 21*b* arranged in continuation with the coil portion 21*c*. For example, the pivotable arm 14 is provided with the pin portion 30, and a rotary member which constitutes the expanding means for causing the arm portion 21*a* or 21*b* of the torsion coil spring 21 to expand upon pivotal movement of the pivotable arm 14, for example, the bearing 31 is rotatably mounted on the pin portion 30. On the other hand, arranged on the housing main body 1 of the rotary potentiometer 11 are the holding pin 20 with the coil portion 21*c* of the above-mentioned torsion coil spring 21 held thereon and the stopper 18 for limiting movements of the arm portions 21*a*, 21*b* of the torsion coil spring 21 in mutually-opposing directions at the neutral position.

It is to be noted that the outer diameter of the above-mentioned holding pin 20 is set substantially smaller than the inner diameter of the coil portion 21*c* of the torsion coil spring 21 and that a threaded portion is formed on the holding pin 20. Further, the outer diameter of the stopper 18 and that of the bearing 31 are set at the same dimension.

This embodiment is also provided with the cover member 22 and the screw 23. The cover member 22 limits movements of the torsion coil spring 21 in directions perpendicular to the predetermined direction and the opposite direction within the above-mentioned vertical plane of the direction X shown in FIG. 6A, and is made, for example, of a metallic material. The screw 23 is maintained in threaded engagement with the threaded portion of the holding pin 20 to fasten the cover member 22 on the holding pin 20.

The remaining elements of structure are constructed similarly and function likewise as the above-described joystick according to the first embodiment.

[Operation of the Second Embodiment]

Figure 9:
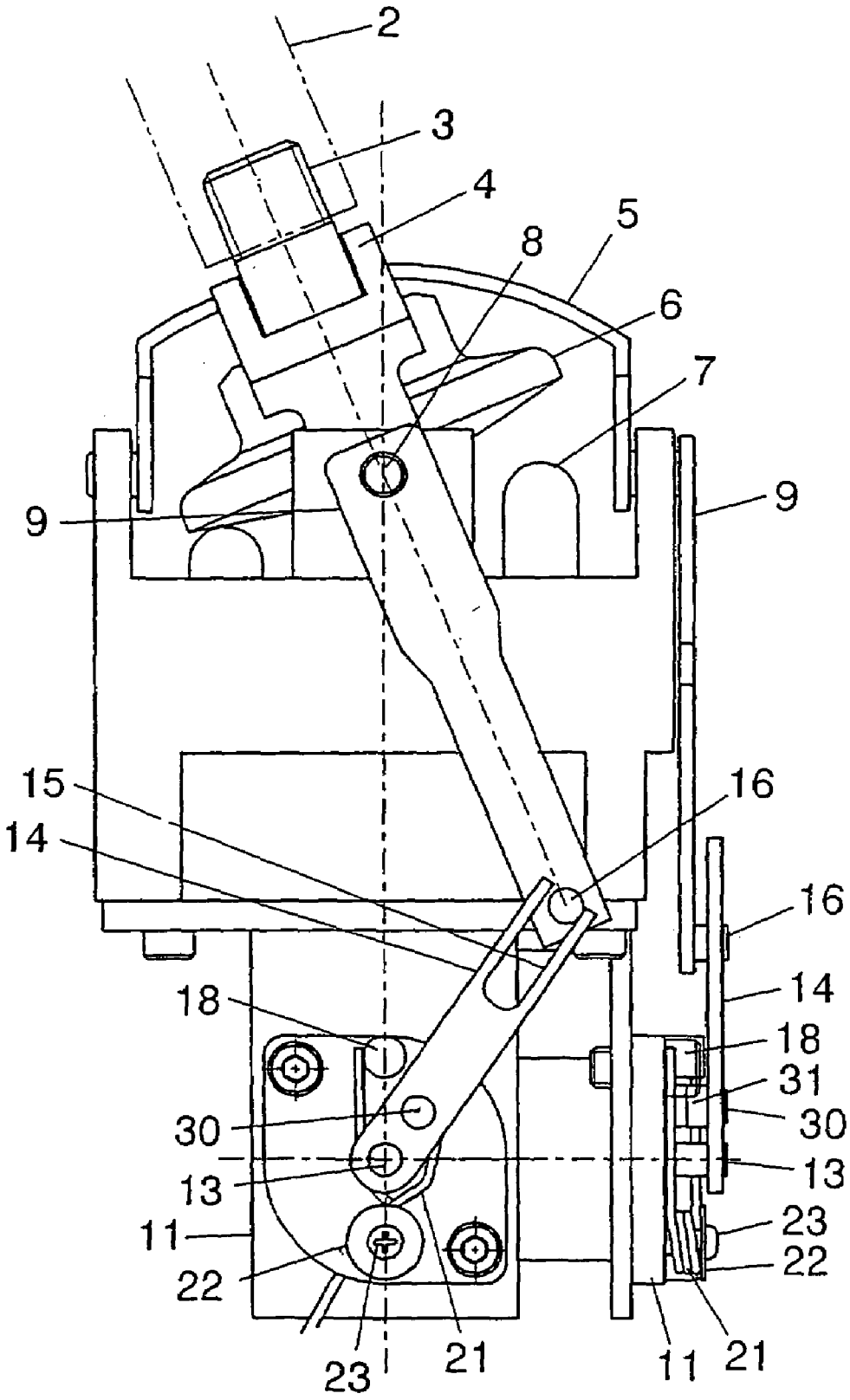
FIG. 9 is a front view illustrating an operation of the joystick according to the second embodiment.
Figure 10:
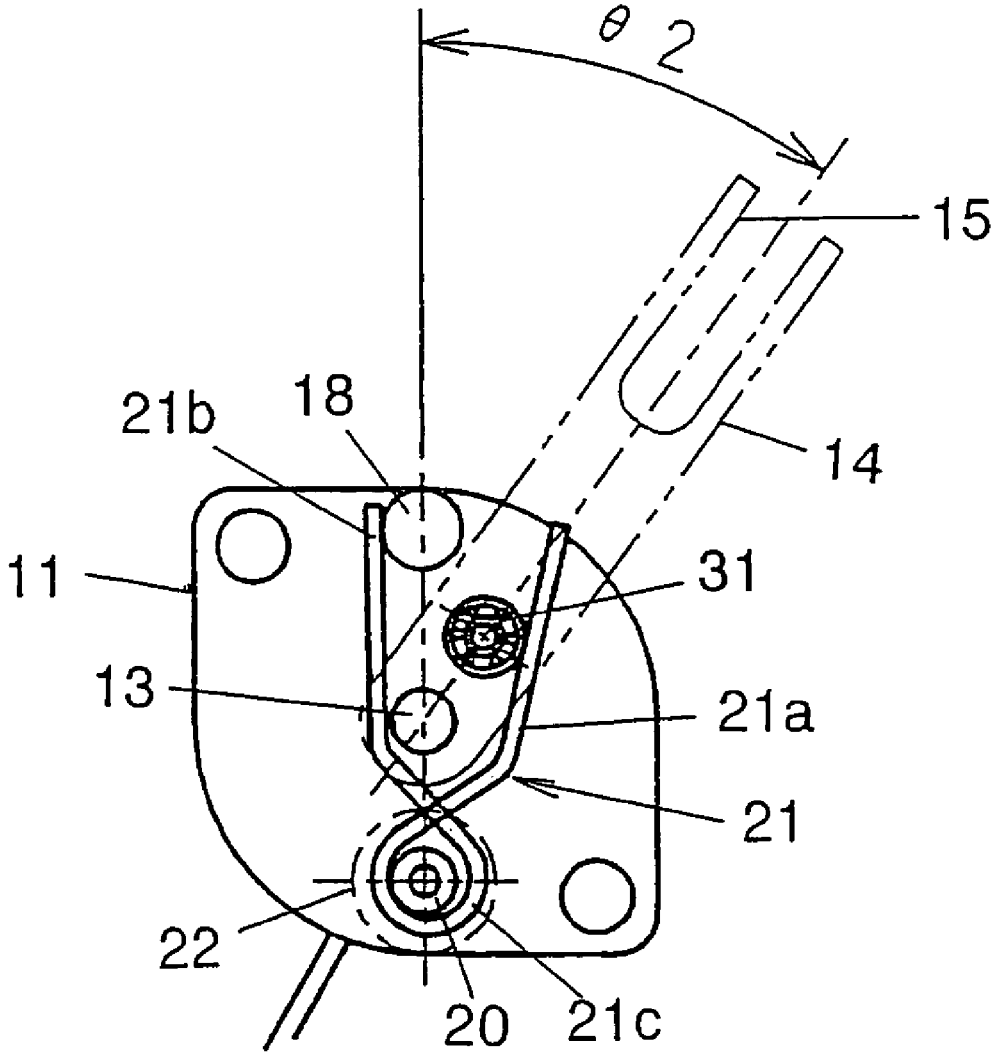
FIG. 10 is a front view showing a torsion coil spring under expansion as a result of the operation illustrated in FIG. 9.

With reference to FIGS. 9 and 10, the operation of the joystick according to this embodiment for the electro-hydraulic control system will next be described. The output characteristics of a rotary potentiometer obtained in this embodiment are as illustrated in FIG. 5 with respect to the first embodiment.

In the state that the control lever 2 is held neutral, movements of the arm portions 21*a*, 21*b* of the torsion coil spring 21 in the predetermined direction and the opposite direction within the vertical plane of the direction X depicted in FIG. 6A are limited by the stopper 18 arranged on the rotary potentiometer 11 as illustrated in FIG. 7C. The torsion coil spring 21 is, therefore, held in the correct position without any substantial inclination, and as a result, the pivotable arm 14 of the rotary potentiometer 11 is held in the normal upright position. Accordingly, the rotary shaft 13 arranged integrally with the pivotable arm 14 is also held in the correct neutral position. In this state, equal clearances are formed on both sides of the protuberance 16 of the extension arm 9, said protuberance 16 being positioned in the slot 15 of the pivotable arm 14. By these clearances, a dead zone for the pivotal control of the control lever 2 is formed. Even when the control lever 2 slightly moves within the dead zone corresponding to the pivotal movement angle θ, no rotation angle signal is hence outputted from the rotary potentiometer 11, thereby preventing false actuation of a hydraulic actuator due to vibrations or the like produced as a result of an operation of an engine mounted on a hydraulic excavator which is equipped with the joystick of this embodiment.

When the control lever 2 shown in FIG. 6B is controlled from such a neutral state in the predetermined direction, for example, in the leftward direction as viewed in FIG. 6B beyond the stroke corresponding to the above-mentioned dead zone, for example, within the vertical plane of the direction X in FIG. 6A, the extension arm 9 pivots about the support pin 8 as shown in FIG. 9. As a result, via the protuberance 16 of the extension arm 9 and the slot 15 of the pivotable arm 14, the pivotable arm 14 of the rotary potentiometer 11 pivots, for example, over an angle θ2 as shown in FIG. 10 against the biasing force of the torsion coil spring 21, and the rotary shaft 13 arranged integrally with this pivotable arm 14 rotates. Accordingly, a rotation angle signal is outputted corresponding to the stroke of the control lever 2. In the meantime, by the bearing 31 mounted on the pin portion 30 of the pivotable arm 14, the arm portion 21*a* of the torsion coil spring 21 is caused to expand and the coil portion 21*c* of the torsion coil spring 21 is caused to contract, as illustrated in FIG. 10. During these changes, the bearing 31 rotates as a result of the expanding motion of the arm portion 21*a*.

When the control lever 2 is controlled back to the neutral position from the position to which the control lever 2 has been controlled as mentioned above, the force applied to the torsion coil spring 21 via the bearing 31 of the pivotable arm 14 is removed so that the torsion coil spring 21 returns into the neutral state. At this time, the bearing 31 and the arm portion 21*a* of the torsion coil spring 21 remain free from abrasion despite the above-mentioned rotation of the bearing 31. In other words, the arm portion 21*a* of the torsion coil spring 21 is maintained in the original form without any deformation so that the torsion coil spring 21 returns to the correct position without any substantial inclination. As a result, the pivotable arm 14 is also held in the original upright position, and the rotary shaft 13 of the rotary potentiometer 11 is allowed to surely return to the correct neutral position. This embodiment, therefore, can obtain the output characteristics which are shown in FIG. 10 and do not produce any output error.

In the above, the description made about the case that the control lever 2 was controlled in the direction X as viewed in FIG. 6A. Similar operations are also performed when the control lever 2 is controlled in the direction Y as viewed in FIG. 6A. When he control lever 2 is controlled in an intermediate direction between the direction X and the direction Y as viewed in FIG. 6A, corresponding rotation angle signals are outputted by similar operations as mentioned above from the two rotary potentiometers 11, respectively.

[Advantageous Effects of the Second Embodiment]

According to this embodiment constructed as described above, when the bearing 31 causes the arm portion 21*a* or 21*b* of the torsion coil spring 21 to expand by a pivotal movement of the pivotable arm 14 of the rotary potentiometer 11 as a result of pivotal control of the control lever 2, the bearing 31 rotates. It is, therefore, possible to reduce abrasion of the bearing 31 and the arm portions 21*a*, 21*b* of the torsion coil spring 21 which 0abrasion takes place as a result of repeated pivotal control of the control lever 2. As a consequence, the bearing 31 and the arm portions 21*a*, 21*b* of the torsion coil spring 21 can be maintained in their original forms without any substantial deformation over a long term, and the pivotable arm 14 of the rotary potentiometer 11, said pivotable arm 14 being in engagement with the torsion coil spring 21, is allowed to surely return to its original neutral position. In other words, it is possible to avoid any displacement of the pivotable arm 14 relative to its original neutral position when the control lever 2 is controlled back to the neutral position. This embodiment, therefore, can obtain the output characteristics free of any output error as shown in FIG. 10.

Third Embodiment

The joystick according to the third embodiment of the present invention for the electro-hydraulic control system will next be described with reference to FIGS. 11A and 11B.

Figure 11A:
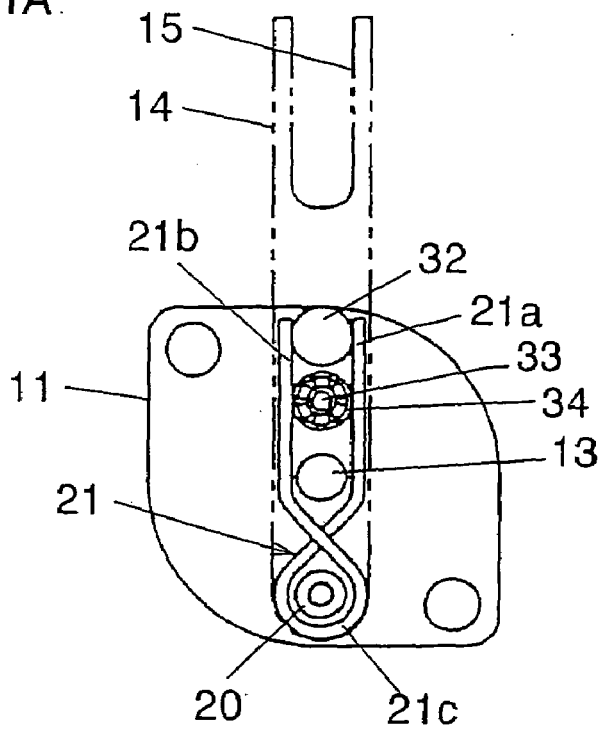
Figure 11B:
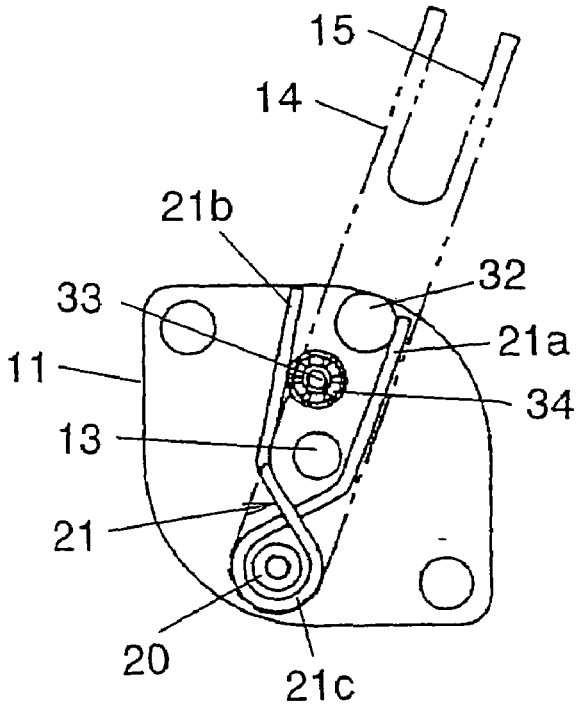
Figure 12A:
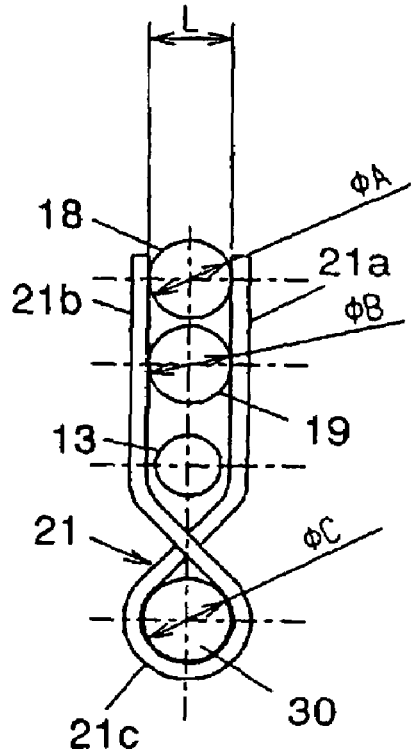
Fig.12A PRIOR ART
FIGS. 12A and 12B are schematic illustrations of a relation between a torsion coil spring and a holding pin, on which the torsion coil spring is held, in the conventional art.
Figure 12B:
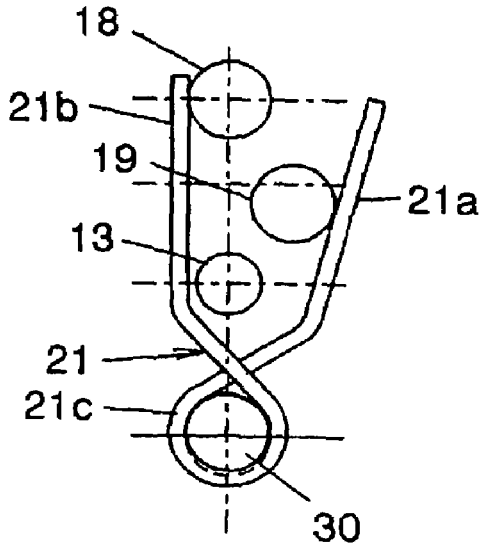
Fig.12B PRIOR ART
Figure 13A:
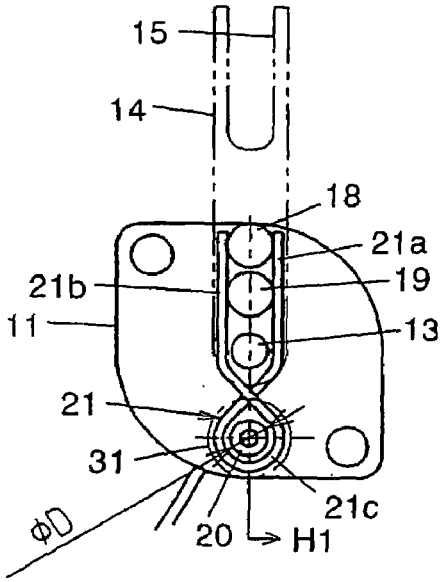
Fig.13A PRIOR ART
Figure 13B:
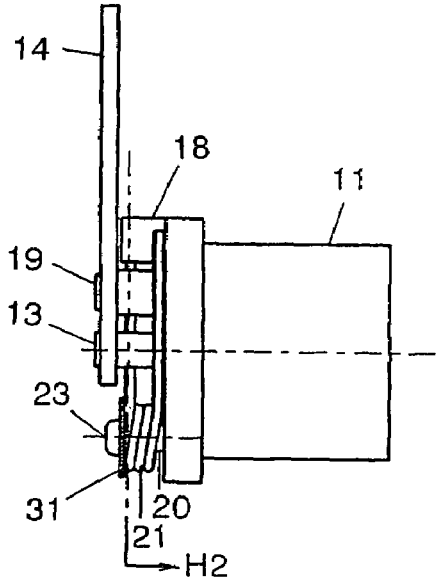
Fig.13B PRIOR ART
Figure 13C:
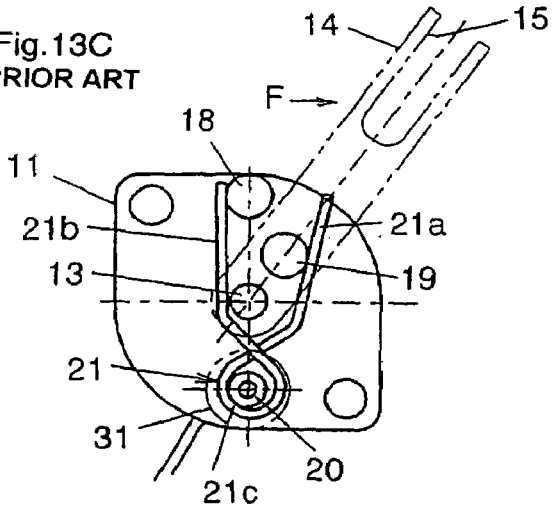
Fig.13C PRIOR ART
Figure 14A:
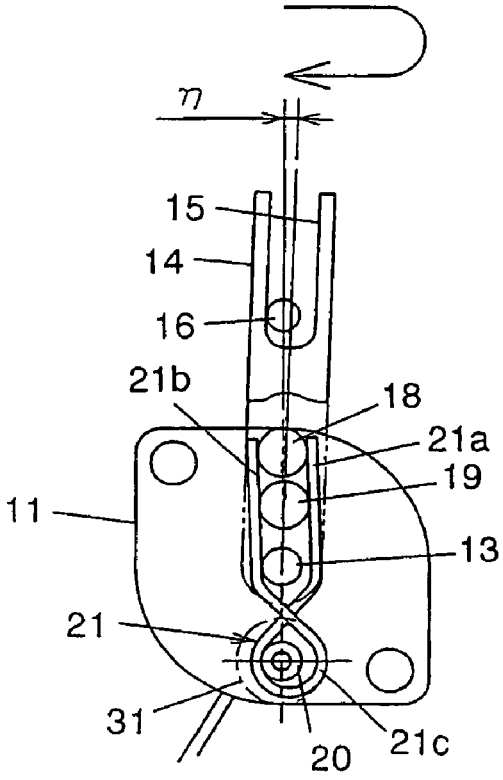
Fig.14A PRIOR ART
Figure 14B:
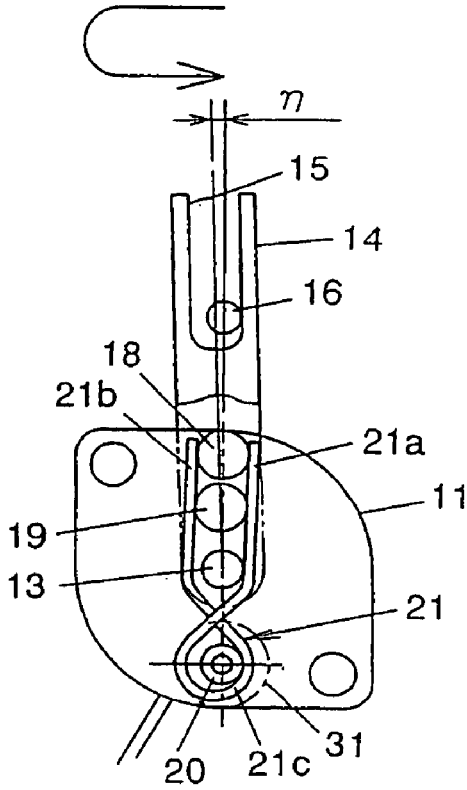
Fig.14B PRIOR ART
Figure 15:
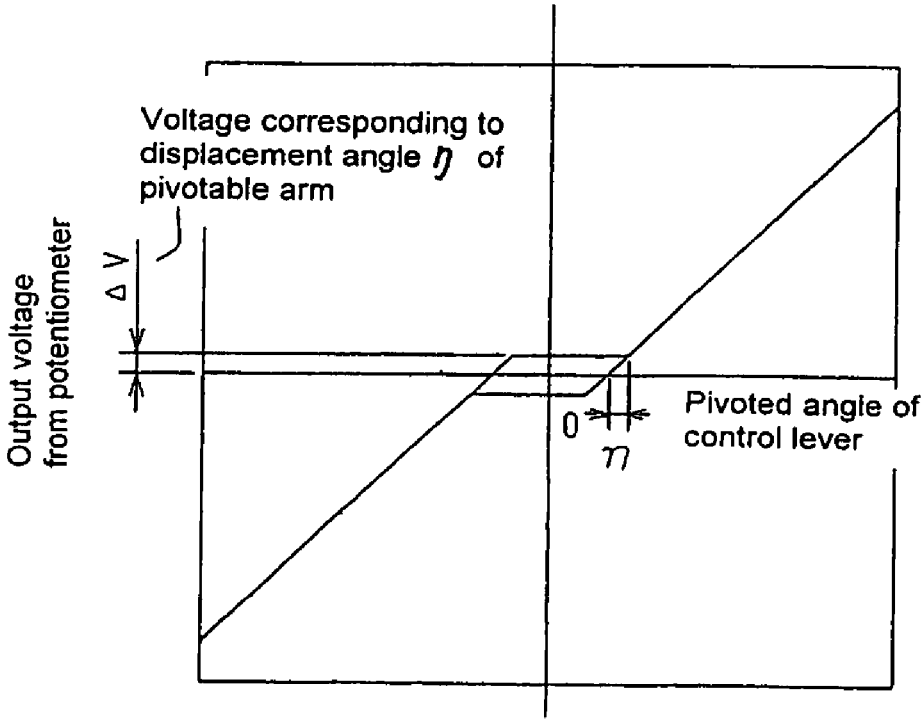
Fig.15 PRIOR ART
FIG. 15 is a diagram showing output characteristics of the rotary potentiometer in the conventional art.
Figure 16:
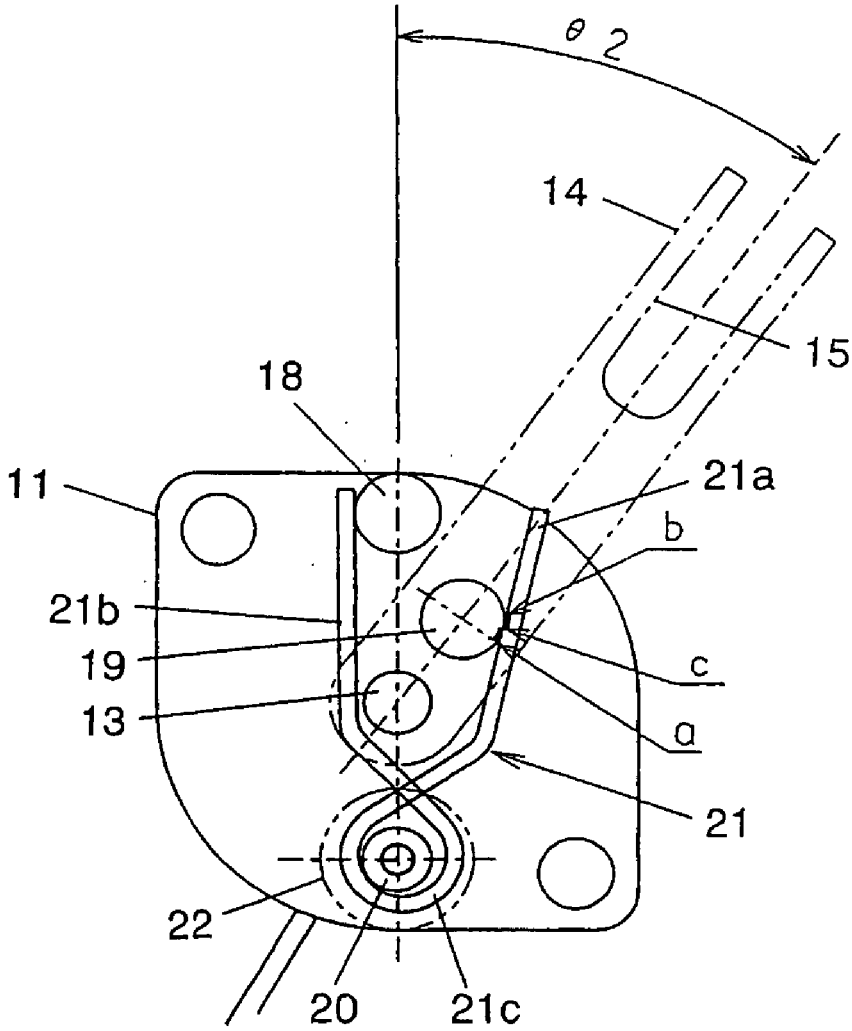
Fig.16 PRIOR ART
FIG. 16 is a front view illustrating an inconvenience which arises in the conventional art, especially a state at the time of control.
Figure 17A:
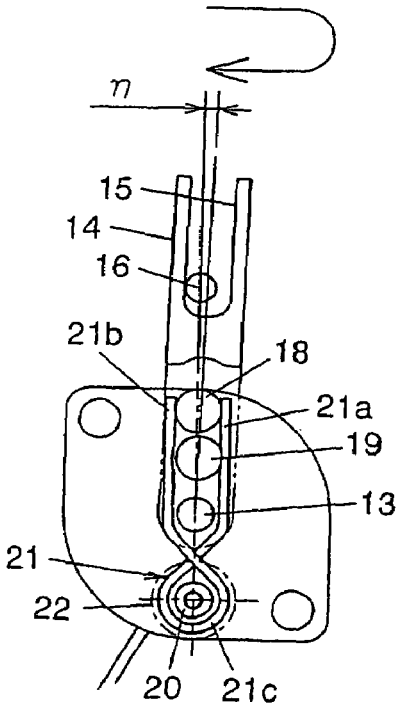
Fig.17A PRIOR ART
Figure 17B:
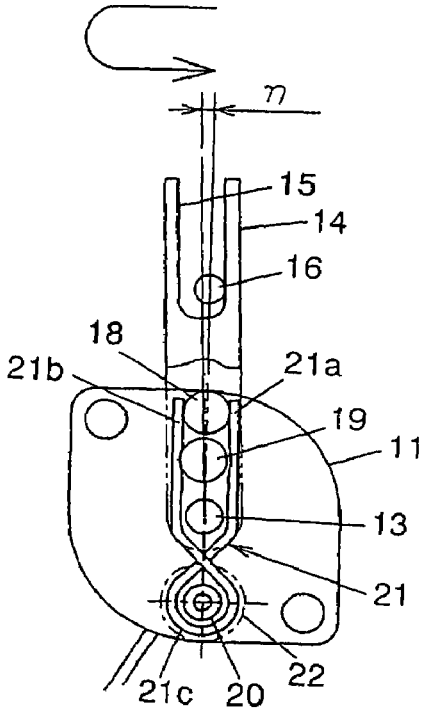
Fig.17B PRIOR ART

The third embodiment illustrated in FIGS. 11A and 11B has a construction that a stopper 32 for limiting movements of the arms 21*a*, 21*b* of the torsion coil spring 21 at its neutral position is arranged on the pivotable arm 14 of the rotary potentiometer 11 and a rotary member, for example, a bearing 34, which constitutes the expanding means for causing the arms 21*a*, 21*b* of the torsion coil spring 21 to expand, is rotatably mounted on a pin portion 33 formed on the housing main body of the rotary potentiometer 11. The remaining construction is similar to that of the above-described second embodiment.

In the third embodiment constructed as described above, whenever the arm portion 21*b* or the like of the torsion coil spring 21 is caused to expand by the bearing 34 upon pivotal control of the control lever 2, the bearing 34 rotates as a result of the expanding operation. It is, therefore, possible to inhibit the occurrence of abrasion between the bearing 34 and the arm portion 21*b*, which is in contact with the bearing 34, or the like of the torsion coil spring 21. When the control lever 2 returns to the neutral position, the pivotable arm 14 is allowed to return to its normal neutral position. The third embodiment can, therefore, bring about similar advantageous effects as the above-mentioned embodiments.

In the above-described embodiment, the rotary member which constitutes the expanding means comprises the bearing. The present invention is, however, not limited to those equipped with bearings as described above. For example, they can be of such a construction that its rotary members may be formed of rotary roller.

This application claims the priorities of Japanese Patent Application 2004-354049 filed Dec. 7, 2004 and Japanese Patent Application 2004-354051 filed Dec. 7, 2004, both of which are incorporated herein by reference.

What is claimed is:

1. A joystick for an electro-hydraulic control system, said joystick being provided with:

a control member pivotally controllable by an operator in a predetermined direction or in a direction opposite to said predetermined direction;

a rocking means rockable as a result of pivotal control of said control member;

a support pin supporting said rocking means thereon;

a rotary potentiometer having a rotary shaft rotatable as a result of a rocking motion of said rocking means, said rotary potentiometer being capable of outputting a rotation angle signal responsive to rotation of said rotary shaft;

an extension arm arranged integrally on said support pin and extending toward said rotary potentiometer;

a pivotable arm connected to said extension arm pivotably within a vertical plane parallel to a plane in which a range of pivotal movements of said extension arm is included, and arranged integrally on said rotary shaft of said rotary potentiometer;

a linkage connecting said pivotable arm and said extension arm together with predetermined clearances interposed therebetween in said predetermined direction and opposite direction in which said control member can be controlled;

a torsion coil spring for normally holding said pivotable arm of said rotary potentiometer in a neutral position;

an expanding means arranged on said pivotable arm to expand said torsion coil spring upon pivotal movement of said pivotable arm; and a holding pin arranged on said rotary potentiometer and holding said torsion coil spring at a coil portion thereof, wherein:

said joystick is provided with a means for limiting movements of said coil portion of said torsion coil spring in said predetermined direction and said opposition direction when said torsion coil spring is in a neutral position.

2. The joystick according to claim 1, wherein:

said joystick is provided with a cover member for limiting movements of said torsion coil spring in directions intersecting at right angles with said predetermined direction and said opposite direction, respectively; and said limiting means comprises a pair of guide portions arranged on said cover member such that, when said torsion coil spring is in said neutral position, said guide portions are maintained in contact with opposite side portions of said coil portion.

3. The joystick according to claim 2, wherein:

said cover member is made of a metallic material; and said guide portions have been formed by bending.

4. The joystick according to claim 2, wherein:

said holding pin of said rotary potentiometer has a threaded portion; and said joystick is provided with a screw maintained in engagement with said threaded portion of said holding pin to fasten said cover member on said holding pin.

5. The joystick according to claim 1, wherein:

said expanding means comprises a pin formed on said pivotable arm.

6. A joystick for an electro-hydraulic control system, said joystick being provided with:

a control member pivotally controllable by an operator;

a rocking means rockable as a result of pivotal control of said control member;

a support pin supporting said rocking means thereon;

a rotary potentiometer having a rotary shaft rotatable as a result of a rocking motion of said rocking means, said rotary potentiometer being capable of outputting a rotation angle signal responsive to rotation of said rotary shaft;

an extension arm arranged integrally on said support pin and extending toward said rotary potentiometer;

a pivotable arm connected to said extension arm pivotably within a vertical plane parallel to a plane in which a range of pivotal movements of said extension arm is included, and arranged integrally on said rotary shaft of said rotary potentiometer;

a torsion coil spring for normally holding said pivotable arm of said rotary potentiometer in a neutral position;

a stopper for limiting movements of arm portions of said torsion coil spring when said torsion coil spring is in a neutral position; and an expanding means for expanding said arm portions of said torsion coil spring upon pivotal movement of said pivotable arm, wherein:

said expanding means comprises a rotary member.

7. The joystick according to claim 6, wherein:

said rotary member comprises a bearing.

8. The joystick according to claim 7, wherein:

said stopper is arranged on a housing main body of said rotary potentiometer, and said bearing is rotatably mounted on a pin portion formed on said pivotable arm of said rotary potentiometer.

9. The joystick according to claim 7, wherein:

said stopper is arranged on said pivotable arm of said rotary potentiometer, and said bearing is arranged on a pin portion formed on a housing main body of said rotary potentiometer.

* * * * *